US009772572B2

(12) United States Patent
Matsusaki et al.

(10) Patent No.: US 9,772,572 B2
(45) **Date of Patent: *Sep. 26, 2017**

(54) ELECTROSTATIC LATENT IMAGE DEVELOPING TONER

(71) Applicant: Konica Minolta, Inc., Tokyo (JP)

(72) Inventors: Mayuko Matsusaki, Hino (JP); Yasuko Uchino, Hino (JP); Natsuko Fujisaki, Hino (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 15/184,317

(22) Filed: Jun. 16, 2016

(65) Prior Publication Data

US 2017/0017176 A1 Jan. 19, 2017

(30) Foreign Application Priority Data

Jul. 17, 2015 (JP) ..... 2015-143386

(51) Int. Cl.
*G03G 9/08* (2006.01)
*G03G 9/087* (2006.01)

(52) U.S. Cl.
CPC ..... *G03G 9/08755* (2013.01); *G03G 9/0821* (2013.01); *G03G 9/0825* (2013.01); *G03G 9/08708* (2013.01); *G03G 9/08726* (2013.01); *G03G 9/08782* (2013.01)

(58) Field of Classification Search
CPC ..... G03G 9/08755; G03G 9/0821; G03G 9/08708; G03G 9/08726
USPC ..... 430/109.4, 110.2
See application file for complete search history.

(56) References Cited

U.S. PATENT DOCUMENTS

| | | | | |
|---|---|---|---|---|
| 5,391,695 | A | 2/1995 | Kawabe et al. | |
| 7,745,085 | B2 * | 6/2010 | Ishiyama | G03G 9/0804 399/106 |
| 9,529,293 | B2 * | 12/2016 | Fujisaki | G03G 9/08755 |
| 2008/0025754 | A1 | 1/2008 | Ishiyama et al. | |
| 2014/0363763 | A1 | 12/2014 | Shibata et al. | |

FOREIGN PATENT DOCUMENTS

| | | | |
|---|---|---|---|
| JP | H04-142301 | A | 5/1992 |
| JP | 2008033057 | A | 2/2008 |
| JP | 2013-190754 | A | 9/2013 |
| JP | 2013257415 | A | 12/2013 |
| JP | 2014-044366 | A | 3/2014 |
| JP | 2014-235394 | A | 12/2014 |

OTHER PUBLICATIONS

Notice of Reasons for Refusal dated Jun. 6, 2017 from corresponding Japanese Patent Application No. JP 2015-143386 and English translation; Total of 11 pages.

* cited by examiner

*Primary Examiner* — Mark A Chapman
(74) *Attorney, Agent, or Firm* — Lucas & Mercanti, LLP

(57) ABSTRACT

Provided is an electrostatic latent image developing toner comprising toner matrix particles that comprise resin components comprising a vinyl resin as a main component and a crystalline resin, and a mold release agent. The electrostatic latent image developing toner includes a structural body in which a portion of the crystalline resin is in contact with the mold release agent, and a portion of the crystalline resin having a thread-like structure that is not in contact with the mold release agent, in cross-sections of the toner matrix particles.

6 Claims, 1 Drawing Sheet

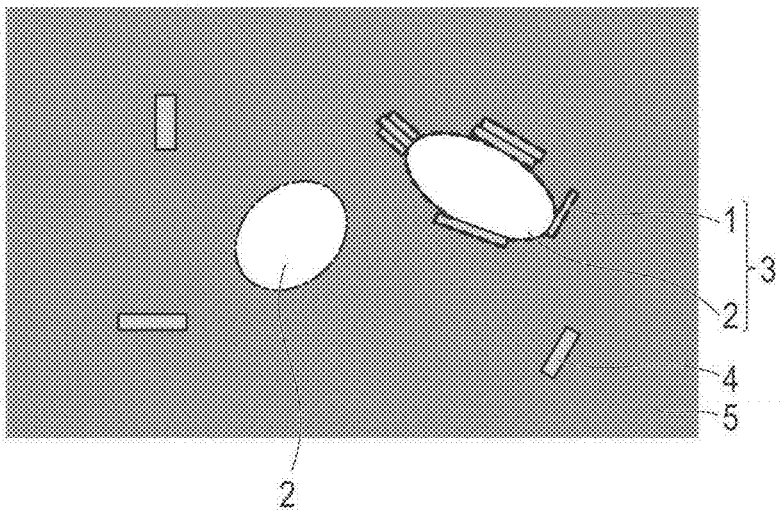
1
3
2
4
5
2

ELECTROSTATIC LATENT IMAGE DEVELOPING TONER

CROSS-REFERENCE TO RELATED APPLICATION

This application claims a priority under the Paris Convention of Japanese patent application No. 2015-143386 filed on Jul. 17, 2015, the entirety of which is incorporated herein by references.

BACKGROUND

1. Technical Field

The present invention relates to an electrostatic latent image developing toner.

2. Description of Related Arts

In recent years, electrophotographic type image forming apparatuses have faced demands for further enhancements in speed, image quality, and the range of applications. Also for the electrostatic latent image developing toners (hereinafter, may be simply referred to as "toners") that are used for those image forming apparatuses, development of toners that can cope with the demands of the market is in rapid progress. For example, with regard to a toner for coping with image quality enhancement, it is requested that the toner have a sharp particle size distribution. When the toner has a uniform particle size, and thus the particle size distribution becomes sharp, the individual toner particles have uniform developing behavior, and the reproducibility of microdots is markedly improved. However, in conventional production methods for toner according to a pulverization method, it has not been easy to obtain a sharp particle size distribution of a toner. In this regard, an emulsion aggregation method has been suggested as a production method capable of arbitrarily controlling the shape of toner particles or the particle size distribution. This method is to obtain toner particles by mixing an emulsion dispersion liquid of resin particles with a colorant particle dispersion liquid, or optionally with a mold release agent dispersion liquid; aggregating individual particles, while stirring the particles, through the addition of an aggregating agent or the control of pH; and fusing the particles through heating.

Furthermore, from the viewpoint of preventive measures for global environmental warming, there is an increasing demand for energy savings even for electrophotographic type image forming apparatuses, and thus, development of low-temperature fixing toners that can be fixed with less energy is in progress. A representative study for lowering the fixing temperature of a toner involves the use of a crystalline material.

For example, in order to achieve sufficient low-temperature fixability, for a toner containing a crystalline polyester resin and an amorphous resin, it has been suggested to promote sharp melting by incorporating the crystalline polyester resin that constitutes the toner matrix particles as a polyester resin having a thread-like crystal structure, and regulating the domain size of the crystalline resin (see, for example, Japanese Patent Application Laid-Open No. 2013-257415). Furthermore, in order to achieve excellent folding endurance and heat storage performance even in a case where a crystalline resin is used, a toner having a structural body in which a crystalline polyester resin and a mold release agent are brought into contact, has been suggested (see, for example, Japanese Patent Application Laid-Open No. 2008-33057).

SUMMARY

As disclosed in the descriptions of Japanese Patent Application Laid-Open No. 2013-257415 and Japanese Patent Application Laid-Open No. 2008-33057, low-temperature fixability can be improved by controlling the crystal structure or the domain size of the crystalline resin that is incorporated into the toner. However, the toners suggested in Japanese Patent Application Laid-Open No. 2013-257415 and Japanese Patent Application Laid-Open No. 2008-33057 have a problem that when the toners are used on various kinds of recording media (paper and the like), the gloss of images varies depending on the recording medium. Furthermore, in the case of the toner described in Japanese Patent Application Laid-Open No. 2008-33057, which contains an amorphous polyester resin as a main component of a binder resin, there is a problem that the environmental dependency of the amount of electric charge is likely to be high, and the demand for image quality improvement cannot be satisfactorily coped with.

Thus, it is an object of the present invention to provide an electrostatic latent image developing toner which has satisfactory low-temperature fixability, exhibits reduced variation in the degree of glossiness in the image caused by the recording medium, that is, has high shape conformity to the recording medium, and exhibits low environmental dependency of the amount of electric charge.

The present inventors conducted a thorough investigation in order to solve the problems described above. As a result, the present inventors found that the problems described above can be solved by an electrostatic latent image developing toner including a structural body in which a crystalline resin is in contact with a mold release agent, and a crystalline resin having a thread-like structure that is not in contact with a mold release agent, in cross-sections of toner matrix particles. Thus, the inventors finally completed the present invention.

According to the invention, there is provided an electrostatic latent image developing toner which has satisfactory low-temperature fixability, high shape conformity to the recording medium, and low environmental dependency of the amount of electric charge.

BRIEF DESCRIPTION OF THE DRAWINGS

FIG. 1 is a schematic diagram illustrating ruthenium-dyed cross-sections of toner matrix particles according to an embodiment of the invention, obtained by observing the toner matrix particles in a secondary electron image using TEM (transmission electron microscopy).

DETAILED DESCRIPTION

Hereinafter, embodiments of the present invention will be described. Meanwhile, the invention is not intended to be limited to the following embodiments.

According to the present specification, the description "X to Y" that represents a range means "X or more and Y or less", and unless particularly stated otherwise, the operations and the measurement of physical properties are carried out under the conditions of room temperature (20° C. to 25° C.) and a relative humidity of 40% RH to 50% RH.

The present invention is an electrostatic latent image developing toner which comprises toner matrix particles comprising resin components that comprise a vinyl resin as a main component and a crystalline resin; and a mold release agent, the electrostatic latent image developing toner including a structural body in which the aforementioned crystalline resin is in contact with the mold release agent (hereinafter, may be simply referred to as "structural body"), and the aforementioned crystalline resin having a thread-like structure that is not in contact with the aforementioned mold release agent (hereinafter, may be simply referred to as "thread-like structure"), in cross-sections of the toner matrix particles. The electrostatic latent image developing toner of the present invention having such a configuration has excellent effects such as satisfactory low-temperature fixability, high shape conformity to the recording medium, and low environmental dependency of the amount of electric charge (excellent chargeability).

It is not clearly understood why the above-described effects are obtained by the toner of the present invention, in connection with the mechanism of manifestation or the mechanism of operation; however, the following is speculated. That is, when a crystalline resin exists in a toner having a vinyl resin as a main component of resin components, since a vinyl resin and a crystalline resin are not very compatible, the crystalline resin is likely to exist in a state of maintaining a crystalline state. Particularly, a thread-like structure is such that if the thread-like structure is surrounded by a vinyl resin, the thread-like structure is likely to exist in a state of maintaining the thread-like without being compatible with the vinyl resin. Thus, as the thread-like structure is finely dispersed, compatibilization of the crystalline resin and the thread-like structure is rapidly achieved.

Furthermore, in the case of a structural body in which a crystalline resin is in contact with a mold release agent, if the structural body is surrounded by a vinyl resin, the structural body is also likely to exist without being compatible with the vinyl resin. That is, among the resin components related to the present invention, two species, such as the structural body and the thread-like structure, can co-exist more easily, and when the system is in a state in which these two species co-exist, control of the bleeding of the mold release agent, and rapid compatibilization of a crystalline resin and a vinyl resin can be realized. Thereby, the entire toner becomes soft, and low-temperature fixability can be secured even if the recording medium (medium) has large surface unevenness. Also, since the bleeding of the mold release agent can be made constant in a large temperature range, even if the recording medium is changed, variation of the glossiness in an image (toner image) can be suppressed. That is, a toner having satisfactory low-temperature fixability and excellent shape conformity to the recording medium (medium) can be provided. Also, since a vinyl resin is incorporated as a main component, a toner having low environmental dependency of the amount of electric charge can be provided. The reason for this is not clearly understood; however, it is speculated that since vinyl resins are not easily affected by moisture, even if the environment is changed, the change in the amount of electric charge becomes small. When the environmental dependency of the amount of electric charge is small, an effect that even in a case where images are printed out in different environments, the image quality does not easily change, is obtained. Therefore, the demand for image quality improvement, which is increasing in recent years, can be coped with.

In a case where there is only a finely dispersed crystalline resin having a thread-like structure, bleeding of the mold release agent cannot be suppressed, the amount of bleeding of the mold release agent is varied to a large extent by the fixing conditions, and the gloss in images tends to change to a large extent. Furthermore, in a case where there is only the structural body in which a crystalline resin is in contact with a mold release agent, the rate of compatibilization between the crystalline resin and the vinyl resin is decreased, and the low-temperature fixability tends to be deteriorated. Therefore, according to the toner of the present invention in which a structural body and a crystalline resin having a thread-like structure that is not in contact with a mold release agent exist in cross-sections of toner matrix particles, an electrostatic latent image developing toner which has satisfactory low-temperature fixability, high shape conformity to the recording medium, and low environmental dependency of the amount of electric charge, is provided.

Meanwhile, the mechanism described above is based on a presumption, and the present invention is not intended to be limited by the mechanism.

Hereinafter, the electrostatic latent image developing toner of the present invention will be described in detail. Meanwhile, the "toner" related to the present invention contains "toner matrix particles" as described above. The "toner matrix particles" will be referred to as "toner particles", after external additives are added. The "toner" means aggregates of the "toner particles".

[Toner Matrix Particles]

The toner matrix particles related to the present invention contains resin components including a vinyl resin as a main component and a crystalline resin. Also, the toner matrix particles include a mold release agent, and may optionally contain other toner constituent components such as a colorant, a magnetic component, and a charge control agent.

<Resin Components (Vinyl Resin and Crystalline Resin)>

The toner matrix particles related to the present invention include resin components including a vinyl resin as a main component and a crystalline resin.

<<Vinyl Resin>>

A vinyl resin is a resin obtainable by polymerization using at least a vinyl monomer. Specific examples of the vinyl resin include an acrylic resin and a styrene-acrylic copolymer resin. Also, a hybrid resin in which vinyl resin units and resin units other than a vinyl resin (for example, amorphous polyester resin units) are chemically bonded, may also be included in the vinyl resin.

Among them, the vinyl resin is preferably a styrene-acrylic copolymer resin formed using a styrene monomer and a (meth)acrylic acid ester monomer. Meanwhile, the vinyl resin may be used singly, or two or more kinds thereof may be used in combination.

In regard to the toner of the present invention, it is one feature that a vinyl resin is a main component of the resin components included in the toner. Here, the main component means a resin that is included at the highest content proportion among the resin components included in the toner. When a vinyl resin is a main component, and particularly in a case where the crystalline resin is a crystalline polyester resin, the vinyl resin and the crystalline polyester resin are not easily compatibilized with each other, and the crystalline polyester resin can easily exist in a state of maintaining the crystal structure. Particularly, when a vinyl resin is a main component, a thread-like structure may exist without difficulty. Thereby, a toner having satisfactory low-temperature fixability and shape conformity to the recording medium (medium) can be provided. Furthermore, when a vinyl resin is a main component, a toner having low environmental dependency of the amount of electric charge, that is, a toner having satisfactory chargeability can be provided.

As described above, the vinyl resin is a resin that is included at the highest content proportion among the resin components included in the toner, and the content of the vinyl resin is preferably 50% to 99% by mass, more preferably 50% to 95% by mass, and even more preferably 65% to 95% by mass, relative to the total amount of the resin components in the toner. When the content of the vinyl resin is 50% by mass or more, the effects of suppressing compatibilization with the crystalline resin and enhancing chargeability become higher, and when the content is 65% by mass or more, the effects tend to become even higher. Also, from the viewpoint of enhancing the low-temperature fixability, the content is preferably 99% by mass or less, and more preferably 95% by mass or less.

Meanwhile, the content of the vinyl resin as described above is the content of all vinyl resins relative to the total amount of the resin components included in the toner. For example, when the resin components include a hybrid resin in which a resin other than the crystalline resin or the vinyl resin has a hybrid structure with a vinyl resin, the content of the vinyl resin unit in the hybrid resin is also included in the content of vinyl resins described above, in addition to the content of the vinyl resin as a main component that is included in the toner.

Regarding the vinyl monomer that forms the vinyl resin, any one kind or two or more kinds selected from the vinyl monomers described below can be used.

(1) Styrene Monomers

Styrene, o-methylstyrene, m-methylstyrene, p-methylstyrene, α-methylstyrene, p-phenylstyrene, p-ethylstyrene, 2,4-dimethylstyrene, p-tert-butylstyrene, p-n-hexylstyrene, p-n-octylstyrene, p-n-nonylstyrene, p-n-decylstyrene, p-n-dodecylstyrene, derivatives thereof, and the like.

(2) (Meth)acrylic Acid Ester Monomers

Methyl (meth)acrylate, ethyl (meth)acrylate, n-butyl (meth)acrylate, isopropyl (meth)acrylate, isobutyl (meth) acrylate, t-butyl (meth)acrylate, n-octyl (meth)acrylate, 2-ethylhexyl (meth)acrylate, stearyl (meth)acrylate, lauryl (meth)acrylate, phenyl (meth)acrylate, diethylaminoethyl (meth)acrylate, dimethylaminoethyl (meth)acrylate, derivatives thereof, and the like.

(3) Vinyl Esters

Vinyl propionate, vinyl acetate, vinyl benzoate, and the like.

(4) Vinyl Ethers

Vinyl methyl ether, vinyl ethyl ether, and the like.

(5) Vinyl Ketones

Vinyl methyl ketone, vinyl ethyl ketone, vinyl hexyl ketone, and the like.

(6) N-Vinyl Compounds

N-vinylcarbazole, N-vinylindole, N-vinylpyrrolidone, and the like.

(7) Others

Vinyl compounds such as vinylnaphthalene and vinylpyridine; acrylic acid or methacrylic acid derivatives such as acrylonitrile, methacrylonitrile, and acrylamide; and the like.

Furthermore, regarding the vinyl monomer, for example, it is preferable to use a monomer having an ionic dissociable group such as a carboxyl group, a sulfonic acid group or a phosphoric acid group. Specific examples include the following monomers.

Examples of the monomer having a carboxyl group include acrylic acid, methacrylic acid, maleic acid, itaconic acid, cinnamic acid, fumaric acid, maleic acid monoalkyl ester, and itaconic acid monoalkyl ester. Examples of the monomer having a sulfonic acid group include styrenesulfonic acid, allylsulfosuccinic acid, and 2-acrylamido-2-methylpropanesulfonic acid. Furthermore, examples of the monomer having a phosphoric acid group include acid phosphoxyethyl methacrylate.

Furthermore, a polyfunctional vinyl compound can be used as the vinyl monomer, and the vinyl resin can be produced into a vinyl resin having a crosslinked structure. Examples of the polyfunctional vinyl compound include divinylbenzene, ethylene glycol dimethacrylate, ethylene glycol diacrylate, diethylene glycol dimethacrylate, diethylene glycol diacrylate, triethylene glycol dimethacrylate, triethylene glycol diacrylate, neopentyl glycol dimethacrylate, and neopentyl glycol diacrylate.

The method for producing the vinyl resin is not particularly limited, and there may be used a method of performing polymerization by a known polymerization technique such as bulk polymerization, solution polymerization, an emulsion polymerization method, a mini-emulsion method, or a dispersion polymerization method, using an arbitrary polymerization initiator such as a peroxide, a persulfide, or an azo compound, which are usually used for the polymerization of the monomers described above. Furthermore, for the purpose of regulating the molecular weight, a chain transfer agent that is commonly used can be used. The chain transfer agent is not particularly limited, and examples thereof include an alkylmercaptan and a mercapto fatty acid ester.

The vinyl resin is preferably an amorphous resin having a glass transition point (Tg) of 25° C. to 60° C., and more preferably an amorphous resin having a glass transition point (Tg) of 35° C. to 55° C. Meanwhile, according to the present specification, the glass transition point (Tg) of a resin is a value measured using "DIAMOND DSC" (manufactured by PerkinElmer, Inc.). Regarding the measurement procedure, 3.0 mg of a measurement sample (resin) is sealed in an aluminum pan, and the aluminum pan is mounted on a holder. For the reference, a blank aluminum pan is used. Regarding the measurement conditions, measurement is carried out by controlling temperature so as to follow a cycle of Heat-Cool-Heat at a measurement temperature of 0° C. to 200° C., a rate of temperature increase of 10° C./min, and a rate of temperature decrease of 10° C./min. An analysis is conducted based on the data collected from the $2^{nd}$ Heat section, and an intersection point between an extension line of the baseline before the rise of a first endotherm peak, and a tangent line that is drawn between the rise portion of the first peak and the peak apex and exhibits the maximum gradient, is designated as the glass transition point.

Furthermore, regarding the molecular weight of the vinyl resin measured by gel permeation chromatography (GPC), the weight average molecular weight (Mw) is preferably 10,000 to 100,000. Meanwhile, according to the present specification, the molecular weight of a resin by GPC is a value measured as follows. That is, an apparatus "HLC-8120GPC" (manufactured by Tosoh Corp.) and columns "TSKguardcolumn+TSKgel SuperHZ-M3 series" (manufactured by Tosoh Corp.) are used, and while the column temperature is maintained at 40° C., tetrahydrofuran (THF) is passed as a carrier solvent at a flow rate of 0.2 mL/min. A measurement sample (Resin) is dissolved in tetrahydrofuran to a concentration of 1 mg/ml under the dissolution conditions of performing a treatment for 5 minutes using an ultrasonic dispersing machine at room temperature, and then the solution is treated with a membrane filter having a pore size of 0.2 μm to obtain a sample solution. 10 μL of this sample solution is injected into the apparatus together with the carrier solvent described above, and the molecular weight is detected using a refractive index detector (RI detector). The molecular weight distribution of the measurement sample is calculated using a calibration curve measured using monodisperse polystyrene standard particles. Ten samples of the polystyrene for calibration curve measurement are used.

<<Crystalline Resin>>

The crystalline resin is not particularly limited as long as it is a resin having crystallinity, and any crystalline resin that is conventionally known in the art to which the present invention is pertained can be used. Specific examples thereof include a crystalline polyester resin, a crystalline polyurethane resin, a crystalline polyurea resin, a crystalline polyamide resin, and a crystalline polyether resin. The crystalline resin may be used singly, or two or more kinds may be used in combination.

Among them, it is preferable that the crystalline resin includes a crystalline polyester resin. Here, the "crystalline polyester resin" refers to a resin which has not a stepwise endothermic change but a clear endotherm peak in differential scanning calorimetry (DSC), among those known polyester resins that are obtainable by a polycondensation reaction between a divalent or higher-valent carboxylic acid (polyvalent carboxylic acid) or a derivative thereof and a dihydric or higher-hydric alcohol (polyhydric alcohol) or a derivative thereof. A clear endotherm peak means an endotherm peak whose full width at half maximum is 15° C. or less when a differential scanning calorimetric (DSC) analysis is carried out at a rate of temperature increase of 10° C./min. Examples of the polyvalent carboxylic acid derivative include an alkyl ester, an acid anhydride, and an acid chloride of a polyvalent carboxylic acid. Examples of the polyhydric alcohol derivative include an ester compound of a polyhydric alcohol and a hydroxycarboxylic acid.

A polyvalent carboxylic acid is a compound containing two or more carboxyl groups in one molecule. Among these, a divalent carboxylic acid is a compound containing two carboxyl groups in one molecule, and examples thereof include saturated aliphatic dicarboxylic acids such as oxalic acid, malonic acid, succinic acid, adipic acid, pimelic acid, sebacic acid, azelaic acid, n-dodecylsuccinic acid, 1,9-nonanedicarboxylic acid, 1,10-decanedicarboxylic acid, 1,11-undecanedicarboxylic acid, 1,12-dodecanedicarboxylic acid (tetradecanedioic acid), 1,13-tridecanedicarboxylic acid, and 1,14-tetradecanedicarboxylic acid; alicyclic dicarboxylic acids such as cyclohexanedicarboxylic acid; unsaturated aliphatic dicarboxylic acids such as maleic acid, fumaric acid, citraconic acid, and itaconic acid; and aromatic dicarboxylic acids such as phthalic acid, isophthalic acid, and terephthalic acid. Furthermore, examples of a polyvalent carboxylic acid other than the divalent carboxylic acid include trivalent or higher-valent polyvalent carboxylic acids such as trimellitic acid and pyromellitic acid. Furthermore, examples of a derivative of the polyvalent carboxylic acid include anhydrides of these carboxylic acid compounds and $C_{1-3}$ alkyl esters of these carboxylic acid compounds. These may be used singly, or two or more kinds thereof may be used in combination.

A polyhydric alcohol is a compound containing two or more hydroxyl groups in one molecule. Among the polyhydric alcohols, a dihydric polyol (diol) is a compound containing two hydroxyl groups in one molecule, and examples thereof include aliphatic diols such as ethylene glycol, 1,2-propanediol, 1,3-propanediol, 1,4-butanediol, 1,5-pentanediol, 1,6-hexanediol, 1,7-heptanediol, 1,8-octanediol, 1,9-nonanediol, 1,10-decanediol, 1,12-dodecanediol, neopentyl glycol, and 1,4-butenediol. Furthermore, examples of a polyol other than a dihydric polyol include polyhydric alcohols having a valence of 3 or higher, such as glycerin, pentaerythritol, trimethylolpropane, and sorbitol. These may be used singly, or two or more kinds thereof may be used in combination.

Furthermore, the crystalline resin may partially have branches, crosslinked sites or the like depending on the selection of the valence of the polyvalent carboxylic acid, the valence of the polyhydric alcohol, and the like.

The crystalline resin related to the present invention may include a crystalline resin having a hybrid structure. A crystalline resin having a hybrid structure (hereinafter, also referred to as hybrid crystalline resin) is a resin in which crystalline resin units and resin units other than a crystalline resin are chemically bonded. A crystalline resin unit represents a moiety derived from a crystalline resin, and a resin unit other than a crystalline resin represents a moiety derived from a resin other than a crystalline resin. Examples of the resin other than a crystalline resin include a vinyl resin such as a styrene-acrylic resin; a urethane resin, a urea resin, and a polyester resin that does not have crystallinity. The resin unit other than a crystalline resin may be used singly, or two or more kinds thereof may be used in combination.

The melting point (Tm) of the crystalline resin is preferably 55° C. to 90° C., and more preferably 70° C. to 85° C. When the melting point of the crystalline resin is in the range of 55° C. to 90° C., sufficient low-temperature fixability and excellent hot-offset resistance are obtained. Meanwhile, the melting point of a crystalline resin can be controlled by the resin composition. The melting point of a crystalline resin can be measured using a differential calorimetric analyzer (DSC).

For example, the measurement of the melting point can be carried out using a DSC-7 differential scanning calorimeter (manufactured by PerkinElmer, Inc.) and TAC7/DX thermal analyzer controller (manufactured by PerkinElmer, Inc.). Specifically, 4.50 mg of a sample is sealed in an aluminum pan (KIT No. 0219-0041), and this is mounted on a sample holder of "DSC-7". For the measurement of a reference, a blank aluminum pan is used. Data are obtained based on the measurement conditions (temperature increase and decrease conditions) in which a first temperature increase operation of increasing the temperature of the sample from 0° C. to 200° C. at a rate of increasing temperature of 10° C./min; a cooling operation of cooling the sample from 200° C. to 0° C. at a rate of cooling of 10° C./min; and a second temperature increase operation of increasing the temperature of the sample from 0° C. to 200° C. at a rate of temperature increase of 10° C./min, are carried out in this order. Based on a DSC curve obtainable by this measurement, the temperature at the peak top of an endotherm peak (endotherm peak whose full width at half maximum is 15° C. or less) derived from a crystalline resin during the second temperature increase operation is designated as the melting point.

The weight average molecular weight (Mw) measured by gel permeation chromatography (GPC) of the crystalline polyester resin is preferably in the range of 5,000 to 100,000, and more preferably in the range of 10,000 to 50,000. When the molecular weight is 5,000 or more, compatibility of the crystalline polyester resin with a vinyl resin is suppressed, and heat resistance is further enhanced. When the molecular weight is 100,000 or less, deterioration of the low-temperature fixability can be suppressed.

The content of the crystalline resin is preferably 1% to 48% by mass, more preferably 1% to 45% by mass, and even more preferably 5% to 45% by mass, relative to the total amount of the resin components in the toner. When the content of the crystalline resin is 1% by mass or more, the effect of low-temperature fixability can be exhibited more effectively. When the content is 5% by mass or more, the effect tends to be further enhanced. Also, from the viewpoint of enhancing the environmental dependency of the amount of electric charge or the heat-resistant storability of the toner, the content of the crystalline resin is preferably 48% by mass or less, and more preferably 45% by mass or less.

Meanwhile, the content of the crystalline resin is the content of all crystalline resins with respect to all of the resin components included in the toner. For example, in a case where a hybrid crystalline resin is included as a crystalline resin, in addition to the content of a crystalline resin that does not have a hybrid structure, which is included in the toner, the content of the crystalline resin unit in the hybrid crystalline resin is to be also included in the content of the crystalline resin.

The method for forming a crystalline polyester resin that is preferable as a crystalline resin is not particularly limited, and the relevant resin can be formed by polycondensing (esterifying) the polyvalent carboxylic acid and polyhydric alcohol described above, by utilizing a known esterification catalyst. The details of the production method will be described below.

Meanwhile, as a resin component that is included in the toner of the present invention, another amorphous resin such as an amorphous polyester resin may also be included in addition to the vinyl resin and the crystalline resin. The content of the other amorphous resin is preferably 30% by mass or less relative to the total amount of the resin components in the toner, and it is more preferable that the content is 0% by mass, that is, no other amorphous resin is included.

<Mold Release Agent>

The toner matrix particles of the present invention include a mold release agent. Specific examples of the mold release agent include low molecular weight polyolefins such as polyethylene, polypropylene, and polybutene; silicones that exhibit softening points when heated; fatty acid amides such as oleic acid amide, erucic acid amide, ricinoleic acid amide, and stearic acid amide; plant waxes such as carnauba wax, rice wax, candelilla wax, wood wax, and jojoba oil; animal waxes such as beeswax; hydrocarbon waxes such as paraffin wax, microcrystalline wax, and Fischer-Tropsch wax; and ester waxes such as stearyl stearate, behenyl behenate, butyl stearate, propyl oleate, monostearic acid glyceride, distearic acid glyceride, pentaerythritol tetrabehenic acid ester, diethylene glycol monostearate, dipropylene glycol distearate, distearic acid diglyceride, sorbitan monostearate, and cholesteryl stearate. These mold release agents may be used singly, or two or more kinds thereof may be used in combination.

When a monoester wax is used as a mold release agent, there is a tendency that the thread-like structure related to the present invention, which is not in contact with a mold release agent, is easily formed. On the other hand, when a hydrocarbon wax having less-branched carbon chains and a small molecular weight distribution is used as a mold release agent, the structural body related to the present invention tends to be easily formed. The reason for this is not clearly known; however, it is speculated that the thread-like structure related to the present invention, which is not in contact with a mold release agent, is formed, or the structural body related to the present invention is formed, due to the balance in the affinity of the mold release agent with the crystalline resin or with resins in the surroundings. Therefore, in order to allow the structural body and the thread-like structure to co-exist, it is preferable to use two kinds of mold release agents of different types in combination. For example, when a hydrocarbon wax having less-branched carbon chains and a small molecular weight distribution is used in combination with a monoester wax having one ester bond, the structural body and the thread-like structure tend to easily co-exist. Furthermore, even in a case where a mold release agent is used singly, it is assumed that the structural body and the thread-like structure can be made to co-exist by controlling the balance in the affinity of the mold release agent with the crystalline resin or with resins in the surroundings. Specifically, for example, when use is made of a hydrocarbon wax having heavily branched carbon chains and a relatively large molecular weight distribution, a polyvalent ester wax having plural ester bonds, or a mold release agent having a functionally separated structure such as two or more kinds of functional groups as a result of modification, the structural body can be easily made to co-exist with the thread-like structure. That is, as one method of realizing the configuration that "a structural body in which a crystalline resin is in contact with a mold release agent, and a crystalline resin having a thread-like structure that is not in contact with a mold release agent, exist in cross-sections of the toner matrix particles," which is characteristic to the present invention as described above, a method of appropriately selecting the mold release agent may be used.

For instance, in a case where, as mold release agents, a hydrocarbon wax having a small molecular weight distribution is used in combination with a monoester wax having one ester bond, the ratio of the amounts of use is preferably such that hydrocarbon wax:monoester wax=10:90 to 90:10 (mass ratio).

The branching of carbon chains or the molecular weight distribution of the hydrocarbon wax can be obtained by, for example, analyzing the n-paraffin ratio or the width of distribution of the number of carbon atoms through a gas chromatography analysis.

Here, according to the present invention, when it is said that carbon chains are less branched, it specifically means that the n-paraffin ratio is 85% or more. Also, when it is said that carbon chains are heavily branched, it specifically means that the n-paraffin ratio is less than 85%.

Furthermore, according to the present specification, the molecular weight distribution of a hydrocarbon wax represents, specifically, a number obtained by adding 1 to the difference between the number of carbon atoms of a hydrocarbon having the largest number of carbon atoms and the number of carbon atoms of a hydrocarbon having the smallest number of carbon atoms among the hydrocarbons detected in an area proportion of 0.1% or more by a gas chromatography analysis. For example, in a case where the number of carbon atoms of a hydrocarbon having the largest number of carbon atoms is 30, and the number of carbon atoms of a hydrocarbon having the smallest number of carbon atoms is 10, the molecular weight distribution is 21.

Furthermore, according to the present invention, the phrase "having a small molecular weight distribution" indicates that the molecular weight distribution is 37 or less, and the phrase "having a large molecular weight distribution" indicates that the molecular weight distribution is 38 or more.

Regarding the mold release agent, from the viewpoint of reliably obtaining the low-temperature fixability and mold releasability of the toner, it is preferable to use a mold release agent having a melting point of 50° C. to 95° C. The content proportion of the mold release agent in the toner is preferably 2% to 20% by mass relative to the total amount of the resin components in the toner.

<State of Existence of Crystalline Resin>

According to the present invention, it is characterized in that a structural body in which a crystalline resin is in contact with a mold release agent, and a crystalline resin having a thread-like structure that is not in contact with a mold release agent, are included in the cross-sections of toner matrix particles. Here, if a crystalline resin and a mold release agent exist to be in contact even at a single site, this structure is included in the "structural body" related to the present invention, and this means a composite between the crystalline resin and the mold release agent. Furthermore, the "thread-like structure" is a structure formed by a crystalline resin through folding of the molecular chains, without being crystallized, and this means a thread-shaped structure formed from one or several molecular chains.

Regarding the method of checking the presence or absence of the structural body and the thread-like structure, for example, a method of dyeing, through ruthenium dyeing, the toner matrix particles obtained by eliminating external additives from toner particles, and then observing the cross-sections of the toner matrix particles by transmission electron microscopy (TEM), may be used.

FIG. 1 is a schematic diagram obtained when the cross-sections of the toner matrix particles according to an embodiment of the present invention are ruthenium-dyed, and then the cross-sections are observed in secondary electron images using TEM (transmission electron microscopy). As shown in FIG. 1, in the cross-sections of the toner matrix particles according to an embodiment of the present invention, there are domains of a structural body 3 (parts surrounded by dotted lines in FIG. 1), in which a crystalline resin 1 and a mold release agent 2 (parts surrounded by dash-dot lines in FIG. 1) are in contact, and domains of a crystalline resin 4 having a thread-like structure (parts surrounded by solid lines in FIG. 1) that is not in contact with a mold release agent, in a vinyl resin 5 as a matrix.

In a contrast image, portions of whiter contrast are considered to represent the mold release agent. Since resin components other than the mold release agent have many double bond moieties and are dyed with ruthenium tetroxide, the mold release agent portions can be distinguished from the resin portions other than the mold release agent. That is, as shown in FIG. 1, the mold release agent is dyed most lightly by ruthenium dyeing, subsequently the crystalline resin having a thread-like structure and the crystalline resin forming the structural body are dyed dark, and the vinyl resin is dyed most darkly.

Specifically, the cross-sections of toner matrix particles can be observed by, for example, an observation method such as described below.

<Method of Observing Cross-Sections of Toner Matrix Particles>

Conditions for Observation

Apparatus: Transmission electron microscope "JEM-2000FX" (manufactured by JEOL, Ltd.)

Sample: Slices of toner matrix particles dyed with ruthenium tetroxide ($RuO_4$) (thickness of slices: 60 nm to 100 nm)

Accelerating voltage: 80 kV

Magnification ratio: 50,000 times, bright field image

Method for Producing Slice of Toner Matrix Particle 3 parts by mass of a toner thus produced is added to 35 parts by mass of a 0.2% aqueous solution of polyoxyethyl phenyl ether, and the mixture is dispersed. Subsequently, the dispersion is treated with ultrasonic waves (manufactured by Nippon Seiki Co., Ltd., US-1200T) for 5 minutes at 25° C., and external additives are eliminated from the toner surface. Thus, toner matrix particles for TEM observation are obtained.

10 mg of the toner matrix particles obtained as described above are dyed once or twice under the conditions of ruthenium tetroxide ($RuO_4$) vapor dyeing as described below, and then the dyed toner matrix particles are disperse in a photocurable resin, "D-800" (manufactured by JEOL, Ltd.). The photocurable resin is cured by UV light, and thereby a block is formed. Subsequently, an ultrathin sample having a thickness of 60 nm to 100 nm is cut out from the block using a microtome equipped with diamond saw teeth.

Conditions for Ruthenium Tetroxide Dyeing

Dyeing is performed using a vacuum electron dyeing apparatus, VSC1R1 (manufactured by Filgen, Inc.). According to the apparatus manual, a sublimation chamber containing ruthenium tetroxide is installed in the dyeing apparatus main body, the ultrathin slice produced as described above is introduced into the dyeing chamber, and then dyeing is performed under the conditions of room temperature (24° C. to 25° C.), a concentration of 3 (300 Pa), and a time of 10 minutes, as the conditions for dyeing with ruthenium tetroxide.

Observation of Crystal Structure

After dyeing, the ultrathin slice is observed within 24 hours in a secondary electron image using a transmission electron microscope, "JEM-2000FX" (manufactured by JEOL, Ltd.).

When the cross-sections of one hundred arbitrary toner matrix particles are observed by the method described above, it is acceptable if toner matrix particles in which the structural body and the thread-like structure exist in the cross-sections thereof, are present at a proportion of 60% (60 particles) or more of the total amount of particles, and it is preferable that such toner matrix particles are present at a proportion of 80% (80 particles) or more. When the proportion is in such a range, enhancement of the low-temperature fixability and the shape conformity to the recording medium, and reduction of the environmental dependency of the amount of electric charge can be achieved efficiently.

Furthermore, according to the present invention, the toner may include a structure other than the structural body and the thread-like structure that is not in contact with a mold release agent, for example, a lamellar structure that is not in contact with a mold release agent. However, in order to efficiently obtain the effects of the present invention, regarding the structure of the crystalline resin other than the structural body and the thread-like structure that is not in contact with the mold release agent, it is preferable that the ratio of the cross-sectional area of the relevant structure with respect to the cross-sectional area of the toner matrix particles is less than 1%, and it is more preferable that the structure does not exist, that is, the ratio of the cross-sectional area is 0%.

<<Structural Body>>

The shape of the structural body is not particularly limited. However, the average domain diameter of the structural body is preferably 150 nm to 3,000 nm, more preferably 200 nm to 2,500 nm, and even more preferably 200 nm to 2,000 nm. If the average domain diameter of the structural body is small, the controllability of bleeding of the mold release agent tends to become weaker. Therefore, it is speculated that when the average domain diameter is preferably 150 nm or more, and more preferably 200 nm or more, the effect of controlling the bleeding of the mold release agent is manifested more effectively. On the other hand, if the average domain diameter of the structural body becomes too large, the low-temperature fixability tends to inhibited. Therefore, in order to secure low-temperature fixability, the average domain diameter is preferably 3,000 nm or less, more preferably 2,500 nm or less, and even more preferably 2,000 nm or less. The average domain diameter of the structural body can be controlled by, for example, the amount of addition of the mold release agent, or the composition of the crystalline resin. For example, when the amount of addition of the mold release agent is increased, the average domain diameter of the structural body tends to become larger.

<<Thread-Like Structure>>

The average major axis of the domains of the thread-like structure is preferably 100 nm to 2,500 nm, more preferably 200 nm to 2,000 nm, and even more preferably 200 nm to 1,000 nm. Furthermore, the average minor axis of the domains of the thread-like structure is preferably 5 nm to 1,500 nm, more preferably 10 nm to 1,000 nm, and even more preferably 10 nm to 500 nm. If the thread-like structure becomes too large, the melting rate at the time of fixing becomes slow, and the rate of compatibilization with the vinyl resin in the surroundings becomes slow. Thus, the effect of enhancing the low-temperature fixability tends to be weakened, and also, shape variation of the toner along the surface unevenness of the recording medium tends to occur with more difficulties. Therefore, the average major axis is preferably 2,500 nm or less, more preferably 2,000 nm or less, and even more preferably 1,000 nm or less. Furthermore, the average minor axis is preferably 1,500 nm or less, more preferably 1,000 nm or less, and even more preferably 500 nm or less. On the other hand, if the thread-like structure becomes too small, bleeding of the mold release agent at the time of fixing occurs excessively, and the degree of glossiness tends to be varied easily. Also, plasticization easily proceeds even at room temperature, and storability of the toner tends to be decreased. Therefore, it is speculated that when the average major axis is 100 nm or more, and when the average minor axis is 5 nm or more, excess bleeding of the mold release agent can be suppressed.

The average major axis and the average minor axis of the domains of the thread-like structure can be controlled by, for example, the amount of addition of the crystalline resin or the composition, and in a case where the toner is produced using a dispersion liquid of the crystalline resin, the average major axis and the average minor axis can be controlled by the dispersion diameter of the crystalline resin in the crystalline resin dispersion liquid. For example, when the amount of addition of the crystalline resin is increased, or the dispersion diameter of the crystalline resin in the crystalline resin dispersion liquid is increased, the thread-like structure tends to become larger. Furthermore, when a crystalline resin having a structure that does not have a hybrid structure is used as the crystalline resin, the thread-like structure tends to be formed more easily.

<<Method for Measuring Sizes (Domain Diameter, Average Major Axis, Average Minor Axis) of Structural Body and Thread-Like Structure>>

The sizes (domain diameters, average major axes, and average minor axes) of the structural body and the thread-like structure can be calculated by analyzing images obtained by making an observation using TEM, by utilizing a commercially available image analysis software program.

For example, the size (domain diameter) of the structural body in a cross-section of a toner matrix particle is calculated as the maximum horizontal chord length (CORD H). Specifically, an image of a cross-section of a toner matrix particle produced as described above is captured using a transmission electron microscope, "JEM-2000FX" (manufactured by JEOL, Ltd.), at a magnification ratio of 50,000 times at an accelerating voltage of 80 kV, the photographic image is captured using a scanner, and the maximum horizontal chord length (CORD H) of the structural body is measured using an image processing analyzer, LUZEX AP (manufactured by Nireco Corp.). Also, similarly, for the major axis (long axis) of the thread-like structure, the maximum length (MX LNG) is measured instead of the maximum horizontal chord length (CORD H), and for the minor axis (short axis), the width (BR' DTH) is measured instead of the maximum horizontal chord length (CORD H). Meanwhile, the width (BR' DTH) is the shortest distance between two straight lines obtainable when an image is interposed between two parallel two straight lines that are disposed at the maximum length (MX LNG). The average domain diameter, the average major axis, and the average minor axis are calculated as arithmetic mean values for one hundred toner matrix particles, in which both the structural body and the thread-like structure are observed.

<<Cross-Sectional Area Proportions of Structural Body, Thread-Like Structure, and Mold Releasing Agent>>

When the ratio of the cross-sectional area of the structural body with respect to the cross-sectional area of the toner matrix particles is designated as A, the ratio of the cross-sectional area of the thread-like structure with respect to the cross-sectional area of the toner matrix particles is designated as B, and the ratio of the cross-sectional area of the mold release agent that does not form the structural body with respect to the cross-sectional area of the toner matrix particles is designated as C, it is preferable that the ratio A/(A+B+C) is 0.3 to 0.75, and more preferably 0.35 to 0.65. When the ratio A/(A+B+C) is in this range, compatibilization between the crystalline resin and the vinyl resin occurs rapidly, so that the low-temperature fixability is further enhanced, and also, the shape conformity to the surface unevenness on the recording medium is further enhanced. Furthermore, excess bleeding of the mold release agent can be suppressed, the variation in glossiness depending on the kind of the recording medium does not easily become noticeable, and the shape conformity to the recording medium is further enhanced.

The proportions A, B and C can be measured, for example, using apparatuses and conditions that are similar to those used for the method for measuring the sizes of the structural body and the thread-like structure described above, and can be measured using "AREA" of the image processing analyzer LUZEX AP (manufactured by Nireco Corp.), instead of the maximum horizontal chord length (CORD H). Meanwhile, for each cross-sectional area, the region surrounded by the outer outline (for example, the region surrounded by dotted lines in FIG. 1 for the structural body, or the region surrounded by solid lines in FIG. 1 for the thread-like structure) is measured. This cross-sectional area proportion is also calculated as an arithmetic mean value for one hundred toner matrix particles in which both the structural body and the thread-like structure are observed.

<Colorant>

In regard to the toner related to the present invention, the toner matrix particles may include a colorant. Examples of the colorant include carbon black, black iron oxide, a dye, and a pigment.

Examples of the carbon black include channel black, furnace black, acetylene black, thermal black, and lamp black. Examples of the black iron oxide include magnetite, hematite, and iron titanium trioxide.

Examples of the dye include C.I. Solvent Red 1, C.I. Solvent Red 49, C.I. Solvent Red 52, C.I. Solvent Red 58, C.I. Solvent Red 63, C.I. Solvent Red 111, C.I. Solvent Red 122, C.I. Solvent Yellow 19, C.I. Solvent Yellow 44, C.I. Solvent Yellow 77, C.I. Solvent Yellow 79, C.I. Solvent Yellow 81, C.I. Solvent Yellow 82, C.I. Solvent Yellow 93, C.I. Solvent Yellow 98, C.I. Solvent Yellow 103, C.I. Solvent Yellow 104, C.I. Solvent Yellow 112, C.I. Solvent Yellow 162, C.I. Solvent Blue 25, C.I. Solvent Blue 36, C.I. Solvent Blue 60, C.I. Solvent Blue 70, C.I. Solvent Blue 93, and C.I. Solvent Blue 95.

Examples of the pigment include C.I. Pigment Red 5, C.I. Pigment Red 48:1, C.I. Pigment Red 48:3, C.I. Pigment Red 53:1, C.I. Pigment Red 57:1, C.I. Pigment Red 81:4, C.I. Pigment Red 122, C.I. Pigment Red 139, C.I. Pigment Red 144, C.I. Pigment Red 149, C.I. Pigment Red 150, C.I. Pigment Red 166, C.I. Pigment Red 177, C.I. Pigment Red 178, C.I. Pigment Red 222, C.I. Pigment Red 238, C.I. Pigment Red 269, C.I. Pigment Orange 31, C.I. Pigment Orange 43, C.I. Pigment Yellow 14, C.I. Pigment Yellow 17, C.I. Pigment Yellow 74, C.I. Pigment Yellow 93, C.I. Pigment Yellow 94, C.I. Pigment Yellow 138, C.I. Pigment Yellow 155, C.I. Pigment Yellow 156, C.I. Pigment Yellow 158, C.I. Pigment Yellow 180, C.I. Pigment Yellow 185, C.I. Pigment Green 7, C.I. Pigment Blue 15:3, and C.I. Pigment Blue 60.

The colorants for obtaining various color toners can be used singly or in combination of two or more kinds for each color. The content proportion of the colorant in the toner matrix particles is preferably 1% to 10% by mass.

<Charge Control Agent>

The toner matrix particles related to the present invention may include a charge control agent. Examples of the charge control agent include a metal complex of a salicylic acid derivative with zinc or aluminum (a salicylic acid metal complex), a calixarene compound, an organoboron compound, and a fluorine-containing quaternary ammonium salt compound.

The content proportion of the charge control agent is usually preferably 0.1 parts to 10 parts by mass, and more preferably 0.5 parts to 5 parts by mass, relative to 100 parts by mass of the resin components in the toner.

<External Additives>

The toner matrix particles related to the present invention can be used directly as toner particles; however, from the viewpoint of enhancing the charging performance, fluidity, or cleaning properties as toner, it is preferable to add particles such as known inorganic microparticles or organic microparticles, a lubricant, and the like as external additives to the surface of the toner matrix particles. Regarding the external additives, various additives may be used in combination. Examples of the particles include inorganic oxide microparticles such as silica microparticles, alumina microparticles, and titania microparticles; inorganic stearic acid compound microparticles such as aluminum stearate microparticles and zinc stearate microparticles; and inorganic titanic acid compound microparticles such as strontium titanate microparticles and zinc titanate microparticles. Furthermore, examples of a lubricating agent include metal salts of higher fatty acids, including salts of stearic acid with zinc, aluminum, copper, magnesium, calcium and the like; salts of oleic acid with zinc, manganese, iron, copper, magnesium, and the like; salts of palmitic acid with zinc, copper, magnesium, calcium, and the like; salts of linoleic acid with zinc, calcium, and the like; and salts of ricinoleic acid with zinc, calcium, and the like. These external additives may be surface-treated with a silane coupling agent, a titanium coupling agent, a fatty acid, a silicone oil or the like, from the viewpoints of heat-resistant storability and environmental stability.

The amount of addition of these external additives is preferably 0.05 parts to 5 parts by mass relative to 100 parts by mass of the toner matrix particles.

<Average Degree of Circularity of Toner>

In regard to the toner related to the present invention, for the individual toner particles that constitute this toner, the average degree of circularity is preferably 0.920 to 1.000, and more preferably 0.950 to 0.995, from the viewpoints of the stability of the charging characteristics and low-temperature fixability. When the average degree of circularity is in the range described above, individual toner particles are not easily pulverized, contamination of triboelectric charging members is suppressed, chargeability of the toner is stabilized, and images thus formed have high image quality. The average degree of circularity of the toner is a value measured using "FPIA-2100" (manufactured by Sysmex Corp.). Specifically, a measurement sample (toner) is mixed thoroughly and evenly with an aqueous solution containing a surfactant, the mixture is dispersed by performing a dispersion treatment for 1 minute. Subsequently, image capturing is performed using "FPIA-2100" (manufactured by Sysmex Corp.) under the measurement conditions of HPF (high power field) mode, at an appropriate density of a number of HPF detections of 3,000 to 10,000. The average degree of circularity is a value calculated by calculating the degree of circularity for individual toner particles according to the following expression, adding the degrees of circularity of various toner particles, and dividing the resultant by the total number of toner particles. When the number of HPF detections is in the range described above, reproducibility is obtained.

Degree of circularity=(Circumferential length of a circle having the same projected area as that of a particle image)/(circumferential length of a projected particle image)

<Toner>

The volume-based median diameter (volume average particle size) of the toner of the present invention is preferably 3 μm to 10 μm, and more preferably 4 μm to 8 μm. When the volume-based median diameter is in this range, reproducibility of fine lines and an improvement of image quality of photographic images can be achieved, and also, the amount of consumption of toner can be reduced compared to a case where a toner having a large particle size is used. Furthermore, toner fluidity can also be secured. The volume average particle size of a toner can be controlled by the concentration of an aggregating agent or the amount of addition of a solvent in the aggregation/fusion process at the time of production of the toner that will be described below, the fusion time, the composition of the resin components, and the like. The volume-based median diameter of the toner can be measured using, for example, "Multisizer 3" (manufactured by Beckman Coulter, Inc.).

[Method for Producing Toner]

Regarding the method for producing the toner of the present invention, for example, a pulverization method, a mini-emulsion method, an emulsion aggregation method, and other known methods may be employed. However, regarding a production method for realizing the configuration that "a structural body in which a crystalline resin is in contact with a mold release agent, and a crystalline resin having a thread-like structure that is not in contact with a mold release agent exist in cross-sections of toner matrix particles," which is characteristic to the present invention as described above, the production method is preferably a production method having a process of cooling the toner matrix particles after controlling the particle size or shape of the toner matrix particles.

It is speculated that when this process of cooling is carried out, since aggregation of a crystallizing substance (for example, the crystalline resin or the mold release agent) can be prevented, the state of co-existence of the structural body and the thread-like structure can be easily achieved. Meanwhile, during the process of cooling, it is preferable to perform rapid cooling. Rapid cooling may vary depending on the temperature before cooling and the target temperature after cooling; however, as a reference, the rate of temperature decrease is 8° C./min or more. This cooling process (preferably, rapid cooling) is carried out after performing the control of the particle size or shape of the toner matrix particles, the state of co-existence of the structural body in which the crystalline resin is in contact with the mold release agent, and the crystalline resin having a thread-like structure that is not in contact with the mold release agent but exists independently, can be maintained more easily. Furthermore, when an emulsion aggregation method is used, it is more preferable from the viewpoints of production costs and production stability, because reduction of the particle size of the toner matrix particles can be easily promoted. Therefore, in a case where an emulsion aggregation method is used, it is more preferable that the toner matrix particles are aggregated until a desired particle size is obtained, shape control is achieved by performing further fusion between the resin particles, and then cooling (preferably, rapid cooling) is performed.

An emulsion aggregation method is a method of producing toner matrix particles by mixing, if necessary, a dispersion liquid of particles of a resin produced by emulsification (hereinafter, also referred to as "resin particles") with a dispersion liquid of particles of a colorant (hereinafter, also referred to as "colorant particles"), aggregating the particles until a desired particle size is obtained, and performing fusion between the resin particles to thereby control the shape of the particles. Here, the resin particles may contain a mold release agent, or optionally, a charge control agent and the like.

Hereinafter, the emulsion aggregation method, which is a preferable production method, will be described.

<Emulsion Aggregation Method>

As described above, the emulsion aggregation method is a method of forming toner matrix particles by mixing, if necessary, a dispersion liquid of resin particles that are dispersed by a surfactant or a dispersion stabilizer, with a dispersion liquid of constituent components of toner matrix particles, such as colorant particles; aggregating the particles until a desired particle size is obtained, by adding an aggregating agent to the particles; subsequently, or simultaneously with aggregation, performing fusion between the resin microparticles; and performing shape control.

For example, the toner matrix particles related to the present invention can be obtained by mixing a water-based dispersion liquid of crystalline resin particles, a water-based dispersion liquid of mold release agent-containing vinyl resin particles, and a water-based dispersion liquid of colorant particles, aggregating the respective particles, and then fusing the particles. Also, instead of a water-based dispersion of mold release agent-containing vinyl resin particles, a water-based dispersion liquid of mold release agent particles and a water-based dispersion liquid of vinyl resin particles may be separately produced and then mixed. It is also possible to use a water-based dispersion liquid of vinyl resin particles containing a crystalline resin, or a water-based dispersion liquid of vinyl resin particles containing a crystalline resin and a mold release agent.

In the case of producing the toner matrix particles according to an emulsion aggregation method, for example, a production method including the following various steps is employed. Here, the following example is an example described in regard to the case where vinyl resin particles contain a mold release agent, crystalline resin particles are crystalline polyester resin particles, and the toner matrix particles contain a colorant. However, the technical scope of the present invention is not intended to be limited to this embodiment.

(a) A step of preparing a dispersion liquid of crystalline polyester resin particles in a water-based medium;

(b) a step of preparing a dispersion liquid containing vinyl resin particles containing a mold release agent, in a water-based medium;

(c) a step of preparing a dispersion liquid of colorant particles in a water-based medium;

(d) a step of mixing the dispersion liquid of crystalline polyester resin particles, the dispersion liquid of mold release agent-containing vinyl resin particles, and the dispersion liquid of colorant particles, and subjecting the crystalline polyester resin particles, the mold release agent-containing vinyl resin particles, and the colorant particles to aggregation and fusion;

(e) an aging step of aging the particles by means of thermal energy, and thereby regulating the shape of the toner matrix particles; and (f) a cooling step of cooling the dispersion liquid of the toner matrix particles.

After the step of (f), (g) a washing and drying step of separating by filtration the toner matrix particles from the water-based dispersion liquid of toner matrix particles, washing off a surfactant and the like from the toner matrix particles, and drying the washing-treated toner matrix particles; (h) an external additive treatment step of adding external additives to the drying-treated toner matrix particles; and the like are further carried out as necessary, and thereby toner particles can be produced.

<<(a) Step of Preparing Dispersion Liquid of Crystalline Polyester Resin Particles>>

The present step is preferably configured to include the following steps.

(A-1) Crystalline polyester resin synthesis step (A-2) Crystalline polyester resin particle dispersion liquid preparation step (A-1) Crystalline Polyester Resin Synthesis Step The method for producing the crystalline polyester resin is not particularly limited, and the crystalline polyester resin can be produced by a general polyester polymerization method of reacting a polyvalent carboxylic acid with a polyhydric alcohol. For example, production is carried out using direct polycondensation, transesterification or the like, appropriately depending on the kind of the monomer. Examples of the catalyst that can be used at the time of production of the crystalline polyester resin include alkali metal compounds of sodium, lithium and the like; alkaline earth metal compounds of magnesium, calcium and the like; metal compounds of zinc, manganese, antimony, titanium, tin, zirconium, germanium and the like; phosphorous acid compounds, phosphoric acid compounds, and amine compounds. Specific examples include the following compounds. Examples include compounds such as sodium acetate, sodium carbonate, lithium acetate, lithium carbonate, calcium acetate, calcium stearate, magnesium acetate, zinc acetate, zinc stearate, zinc naphthenate, zinc chloride, manganese acetate, manganese naphthenate, titanium tetraethoxide, titanium tetrapropoxide, titanium tetraisopropoxide, titanium tetrabutoxide, antimony trioxide, triphenylantimony, tributylantimony, tin formate, tin oxalate, tetraphenyltin, dibutyltin dichloride, dibutyltin oxide, diphenyltin oxide, zirconium tetrabutoxide, zirconium naphthenate, zirconyl carbonate, zirconyl acetate, zirconyl stearate, zirconyl octylate, germanium oxide, triphenyl phosphate, tris(2,4-t-butylphenyl) phosphate, ethyltriphenylphosphonium bromide, triethylamine, triphenylamine, and hydroquinone.

The use ratio of the polyhydric alcohol and the polyvalent carboxylic acid is such that the equivalent ratio between the hydroxyl groups [OH] of the polyhydric alcohol and the carboxyl groups [COOH] of the polyvalent carboxylic acid, [OH]/[COOH], is preferably 1.5/1 to 1/1.5, and more preferably 1.2/1 to 1/1.2. Furthermore, the polymerization temperature or the polymerization time is not particularly limited, and during polymerization, the pressure inside the reaction system may be reduced as necessary.

(A-2) Crystalline Polyester Resin Particle Dispersion Liquid Preparation Step

The crystalline polyester resin particle dispersion liquid preparation step is a step of preparing a dispersion liquid of crystalline polyester resin particles by dispersing the crystalline polyester resin synthesized as described above, into a microparticle form in a water-based medium.

Regarding the method for preparing a crystalline polyester resin particle dispersion liquid, for example, (i) a method of performing a dispersion treatment of a crystalline polyester resin in a water-based medium without using a solvent; or (ii) a method of dissolving a crystalline polyester resin in a solvent such as ethyl acetate, methyl ethyl ketone, or toluene to obtain a solution, emulsifying and dispersing this solution in a water-based medium using a dispersing machine, and then performing a solvent removal treatment (solvent removal step), may be employed.

The "water-based medium" used in the methods (i) and (ii) described above implies that at least water is incorporated at a proportion of 50% by mass or more, and the component other than water may be an organic solvent that dissolves in water. Examples thereof include methanol, ethanol, isopropanol, butanol, acetone, methyl ethyl ketone, dimethylformamide, methyl cellosolve, and tetrahydrofuran. Among these, it is preferable to use an alcohol-based organic solvent such as methanol, ethanol isopropanol or butanol, all of which are organic solvents that do not dissolve the resin. More preferably, only water is used as the water-based medium.

Furthermore, the water-based medium may have an amine emulsification smoothly by emulsifying the resin stably in the aqueous phase. Also, for the purpose of enhancing the dispersion stability of oil droplets, a surfactant, resin microparticles, or the like may be added to the water-based medium.

Regarding the surfactant, any known anionic surfactant, cationic surfactant, nonionic surfactant, or amphoteric surfactant can be used. Regarding the surfactant, it is preferable to use an anionic surfactant from the viewpoint that excellent dispersion stability of oil droplets formed by the crystalline polyester resin is obtained, and stability to temperature change is obtained. Examples of the anionic surfactant include higher fatty acid salts such as sodium oleate; alkyl arylsulfonic acid salts such as sodium dodecyl benzenesulfonate; alkyl sulfuric acid ester salts such as sodium lauryl sulfate (sodium dodecyl sulfate); polyoxyethylene alkyl ether sulfuric acid ester salts such as sodium polyoxyethylene lauryl ether sulfate and sodium polyethoxyethylene lauryl ether sulfate (sodium polyoxyethylene(2) dodecyl ether sulfate); polyoxyethylene alkyl aryl ether sulfuric acid ester salts such as sodium polyoxyethylene nonyl phenyl ether sulfate; alkyl sulfosuccinic acid ester salts such as sodium monooctyl sulfosuccinate, sodium dioctyl sulfosuccinate, and sodium polyoxyethylene lauryl sulfosuccinate; and derivatives thereof. The surfactants described above can be used singly or in combination of two or more kinds, as desired.

Furthermore, examples of the resin microparticles for the enhancement of dispersion stability include polymethyl methacrylate resin microparticles, polystyrene resin microparticles, and polystyrene-acrylonitrile resin microparticles.

In the method (ii), a synthesized crystalline polyester resin is dissolved in an organic solvent, and thus a crystalline polyester resin solution is prepared. Subsequently, the relevant crystalline polyester resin solution is emulsified and dispersed in a water-based medium, and thereby oil droplets formed from the crystalline polyester solution are formed. In this process, when an emulsion prepared by a phase inversion emulsification method is used, it is excellent from the viewpoint that oil droplets can be uniformly dispersed by changing the stability of carboxyl groups of the polyester, and the oil droplets are not forcibly dispersed with shear force as in the case of a mechanical emulsification method. In the "phase inversion emulsification method", a dispersion liquid of resin microparticles is obtained by carrying out a dissolving step of dissolving a resin in an organic solvent and obtaining a resin solution; a neutralization step of introducing a neutralizing agent into the resin solution; an emulsification step of emulsifying and dispersing the neutralized resin solution in a water-based dispersing medium, and obtaining a resin emulsion; and a solvent removal step of removing the organic solvent from the resin emulsion.

The dispersion treatment (emulsification dispersion) in the methods (i) and (ii) described above can be carried out by utilizing mechanical energy. The dispersing machine is not particularly limited, and examples thereof include a wet emulsifying dispersing machine, a homogenizer, a low-speed shear type dispersing machine, a high-speed shear type dispersing machine, a frictional dispersing machine, a high-pressure jet type dispersing machine, an ultrasonic dispersing machine, and a high-pressure impact type dispersing machine, ULTIMIZER.

Meanwhile, the particle size of the crystalline polyester resin particles in the dispersion liquid can be controlled by regulating the amount of addition of the neutralizing agent, that is, by regulating the degree of neutralization. There is observed a tendency in which as the amount of addition of the neutralizing agent is smaller, that is, as the degree of neutralization is lower, the particle size of the resin particles in the dispersion liquid becomes larger.

In the method (ii) described above, when the organic solvent is distilled off from the oil droplets thus formed, particles of the crystalline polyester resin are produced, and a dispersion liquid of the crystalline polyester resin particles is prepared. Specifically, distilling off of the organic solvent is preferably carried out in a state in which the degree of vacuum is considered to be in the range of 400 Pa to 50,000 Pa, and at a temperature in the range of 30° C. to 50° C.

It is preferable that the particle size of the crystalline polyester resin particles is, for example, in the range of 30 nm to 500 nm as the volume-based median diameter. The particle size of the crystalline polyester resin particles can be measured by, for example, a dynamic light scattering method using "MICROTRAC UPA-150" (manufactured by Nikkiso Co., Ltd.).

The dispersion diameter of the crystalline polyester resin particles (oil droplets) in the crystalline polyester resin particle dispersion liquid prepared as described above is preferably 30 nm to 500 nm as the volume-based median diameter (volume average particle size). Meanwhile, this dispersion diameter of the oil droplets can also be controlled by the intensity of the mechanical energy used at the time of emulsification dispersion, or the like. The dispersion diameter of the crystalline polyester resin particles (oil droplets) can be measured by, for example, a dynamic light scattering method using "MICROTRAC UPA-150" (manufactured by Nikkiso Co., Ltd.).

Furthermore, the content of the crystalline polyester resin particles in the crystalline polyester resin particle dispersion liquid is preferably set to the range of 10% to 50% by mass, and more preferably to the range of 15% to 40% by mass, relative to 100% by mass of the dispersion liquid. When the content of the resin particles is in such a range, expansion of the particle size distribution is suppressed, and the toner characteristics can be enhanced.

<<(b) Step of Preparing Dispersion Liquid Including Vinyl Resin Particles Containing Mold Release Agent (Mold Release Agent-Containing Vinyl Resin Particle Dispersion Liquid)>>

The present step is a step of preparing a dispersion liquid of vinyl resin particles by synthesizing a vinyl resin that constitutes the toner matrix particles, dispersing this vinyl resin in a particulate form in a water-based medium, and further adding a mold release agent thereto.

The method for producing a vinyl resin is as described above, and therefore, further details will not be repeated here.

Regarding the method of dispersing a vinyl resin in a water-based medium, (I) a method of forming vinyl resin particles from monomers for obtaining the vinyl resin, and preparing a water-based dispersion liquid of the relevant vinyl resin particles; and (II) a method of preparing an oil phase liquid by dissolving or dispersing the vinyl resin in an organic solvent (solvent), dispersing the oil phase liquid in a water-based medium by phase inversion emulsification or the like, thereby forming oil droplets in a state of being controlled to have a desired particle size, and then removing the organic solvent (solvent), may be employed.

In method (I), first, a monomer intended for obtaining a vinyl resin is added to a water-based medium together with a polymerization initiator, the monomers are polymerized, and thus base particles are obtained. Next, it is preferable to use a technique of adding a radical polymerizable monomer intended for obtaining a vinyl resin and a polymerization initiator to the dispersion liquid in which the base particles are dispersed, and seed polymerizing the radical polymerizable monomer on the base particles. When this radical polymerizable monomer and the polymerization initiator are added, it is preferable to add a mold release agent thereto at the same time.

At this time, regarding the polymerization initiator, a water-soluble polymerization initiator can be used. Regarding the water-soluble polymerization initiator, for example, a water-soluble radical polymerization initiator such as potassium persulfate or ammonium persulfate can be suitably used.

Furthermore, in the seed polymerization reaction system for obtaining the vinyl resin particles, a chain transfer agent that is generally used can be used for the purpose of regulating the molecular weight of the vinyl resin. Regarding the chain transfer agent, octylmercaptan, dodecylmercaptan, t-dodecylmercaptan, n-octyl 3-mercaptopropionate, stearyl 3-mercaptopropionate, styrene dimer, or the like can be used.

In method (II), regarding the organic solvent (solvent) that is used for the preparation of the oil phase liquid, as described above, an organic solvent having a low boiling point and low solubility in water is preferred from the viewpoint that the removal treatment after the formation of oil droplets can be easily carried out. Specific examples thereof include methyl acetate, ethyl acetate, methyl ethyl ketone, isopropyl alcohol, methyl isobutyl ketone, toluene, and xylene. These can be used singly, or two or more kinds thereof can be used in combination.

The amount of use of the organic solvent (solvent) (in the case of using two or more kinds, the total amount of use) is usually 10 parts to 500 parts by mass, preferably 100 parts to 450 parts by mass, and more preferably 200 parts to 400 parts by mass, relative to 100 parts by mass of the vinyl resin.

The amount of use of the water-based medium is preferably 50 parts to 2,000 parts by mass, and more preferably 100 parts to 1,000 parts by mass, relative to 100 parts by mass of the oil phase liquid. When the amount of use of the water-based medium is set to the range described above, the oil phase liquid in the water-based medium can be emulsified and dispersed to have a desired particle size.

Furthermore, as described above, a dispersion stabilizer may be dissolved in the water-based medium, or for the purpose of enhancing the dispersion stability of oil droplets, a surfactant, resin microparticles or the like may be added to the water-based medium. Emulsification dispersion of such an oil phase liquid can be carried out by utilizing mechanical energy as described above. The dispersing machine for performing emulsification dispersion is not particularly limited, and the dispersing machines described in section (A-2) described above can be used.

Removal of the organic solvent after the formation of oil droplets can be carried out by an operation of raising the temperature of the entire dispersion liquid in a state in which vinyl resin particles are dispersed in a water-based medium, slowly in a stirred state, strongly stirring the dispersion liquid over a certain temperature range, and then performing solvent removal. Alternatively, the organic solvent can be removed while pressure is reduced using an apparatus such as an evaporator.

In method (II), a water-based dispersion liquid of a mold release agent (mold release agent particle dispersion liquid) that has been produced separately is added to the dispersion liquid containing vinyl resin particles thus obtained, and a mold release agent-containing vinyl resin particle dispersion liquid is prepared.

Regarding the water-based medium, surfactant, resin microparticles or the like that are used in the water-based dispersion liquid of the mold release agent, the same agents as those described in section (A-2) described above can be used. Furthermore, dispersion of the mold release agent can be carried out by utilizing mechanical energy. Such a dispersing machine is not particularly limited, and the same dispersing machines as those described in section (A-2) can be used.

The content of the mold release agent particles in the mold release agent particle dispersion liquid is preferably set to the range of 10% to 50% by mass, and more preferably to the range of 15% to 40% by mass. When the content is in such a range, effects of preventing hot offset and securing separability are obtained.

The dispersion diameter of the vinyl resin particles (oil droplets) in the vinyl resin particle dispersion liquid prepared by the method (I) or (II) is preferably 60 nm to 1,000 nm, and more preferably 80 nm to 500 nm as the volume-based median diameter (volume average particle size). Meanwhile, this dispersion diameter of the oil droplets can be controlled by the intensity of mechanical energy used at the time of emulsification dispersion, or the like.

Furthermore, the content of the vinyl resin particles in the vinyl resin particle dispersion liquid is preferably set to the range of 5% to 50% by mass, and more preferably to the range of 10% to 30% by mass. When the content is in such a range, expansion of the particle size distribution can be suppressed, and the toner characteristics can be enhanced.

Here, the vinyl resin particles can be produced into composite particles formed in plural layers composed of two or more layers formed from resins of different compositions.

<<(c) Colorant Particle Dispersion Liquid Preparation Step>>

The colorant particle dispersion liquid preparation step is a step of dispersing a colorant in a particulate form in a water-based medium, and preparing a dispersion liquid of colorant particles. It is preferable that the dispersion treatment of the colorant is carried out in a water-based medium in a state in which the surfactant concentration is regulated to be higher than or equal to the critical micelle concentration (CMC), since the colorant is uniformly dispersed.

The relevant water-based medium is as described in section (A-2) described above, and in this water-based medium, a surfactant, resin microparticles or the like may be incorporated for the purpose of enhancing dispersion stability. Also, dispersion of the colorant can be carried out by utilizing mechanical energy. Such a dispersing machine is not particularly limited, and those described in section (A-2) described above can be used.

The dispersion diameter of the colorant particles in the colorant particle dispersion liquid is preferably in the range of 10 nm to 300 nm as the volume-based median diameter. This dispersion diameter of the colorant particles in the colorant particle dispersion liquid can be measured by, for example, a dynamic light scattering method using "MICROTRAC UPA-150" (manufactured by Nikkiso Co., Ltd.).

The content of the colorant in the colorant particle dispersion liquid is preferably set to the range of 10% to 50% by mass, and more preferably to the range of 15% to 40% by mass. When the content is in such a range, an effect of securing color reproducibility is obtained.

<<(d) Aggregation and Fusion Step>>

This aggregation and fusion step is a step of aggregating the crystalline polyester resin particles, the mold release agent-containing vinyl resin particles, and optionally colorant particles, a charge control agent and other constituent components of the toner matrix particles in a water-based medium, and fusing these particles simultaneously with the aggregation, to obtain toner matrix particles.

Regarding a specific method of aggregating and fusing the crystalline polyester resin particles, the following method may be employed: the mold release agent-containing vinyl resin particles, and the optionally used colorant particles, an aggregating agent is added to a water-based medium to a concentration higher than or equal to the critical aggregation concentration, and subsequently, salting out of the particles such as the crystalline polyester resin particles, the mold release agent-containing vinyl resin particles, and the colorant particles is carried out, simultaneously with fusion of the particles, by heating the particles to a temperature that is higher than or equal to the glass transition point of the resin particles and is lower than or equal to the melting peak temperature of the mixture of these particles. Then, when the particles have grown to a desired particle size, particle growth is terminated by adding an aggregation terminating agent to the system, and if necessary, heating is continued in order to control the particle shape. In regard to this method, it is preferable to heat the particles rapidly by setting the time for leaving the system to stand after the addition of an aggregating agent as short as possible, to a temperature that is higher than or equal to the glass transition point of these resin particles and is lower than or equal to the melting peak temperature of the mixture of these particles. The reason for this is not clearly known; however, it is because there is a risk of a problem that the state of aggregation of the particles may vary depending on the time for standing after salting out, so that the particle size distribution is unstabilized, or the surface properties of the fused particles may vary. Usually, the time for this temperature increase is preferably 30 minutes or less, and more preferably 10 minutes or less. Also, the rate of temperature increase is preferably 1° C./min or higher. The upper limit of the rate of temperature increase is not particularly defined; however, from the viewpoint of suppressing the occurrence of coarse particles caused by rapid progress of fusion, it is preferable to set the rate of temperature increase to 15° C./min or lower. Furthermore, after the reaction system has reached to a temperature higher than or equal to the glass transition point, it is important to continue fusion by maintaining the temperature of the relevant reaction system for a certain time. Thereby, growth and fusion of the toner matrix particles can be effectively caused to proceed, and the durability of the toner particles that are finally obtained can be enhanced. According to the present invention, in the aggregation and fusion step, the dispersion liquid of the crystalline polyester resin particles and the dispersion liquid of the mold release agent-containing vinyl resin particles may be introduced in divided portions of a first feed and a second feed.

The aggregating agent that is used for this aggregation and fusion step is not particularly limited; however, an aggregating agent selected from metal salts is suitably used. Examples of the metal salts include monovalent metal salts such as salts of alkali metals such as sodium, potassium, and lithium; divalent metal salts of calcium, magnesium, manganese, and copper; and trivalent metal salts of iron and aluminum. Specific examples of the metal salts include sodium chloride, potassium chloride, lithium chloride, calcium chloride, magnesium chloride, zinc chloride, copper sulfate, magnesium sulfate, and manganese sulfate. Among these, from the viewpoint of being capable of inducing aggregation at a smaller amount, it is particularly preferable to use a divalent metal salt. These can be used singly or in combination of two or more kinds thereof. The particle size of the toner matrix particles obtainable in this aggregation and fusion step is, for example, preferably in the range of 2 μm to 9 μm, and more preferably in the range of 4 μm to 7 μm, as the volume-based median diameter (volume average particle size). The volume-based median diameter of the toner matrix particles can be measured using, for example, "Particle size distribution analyzer Multisizer 3" (manufactured by Beckman Coulter, Inc.).

Meanwhile, in the case of obtaining a resin having a core-shell structure, in the present step, a water-based dispersion liquid of a resin that forms the shell portion is further added, and the resin that forms the shell portion is aggregated and fused on the surface of the resin particles having a single layer structure (core particles) obtained as described above. Thereby, a resin having a core-shell structure is obtained (shell forming step). At this time, subsequently to the shell forming step, a heating treatment of the reaction system, that is, (e) an aging step that will be described below, may be carried out until aggregation and fusion of the shell to the core particle surface is strengthened, and the shape of the particles becomes a desired shape. This heating treatment of the reaction system may be carried out until the average degree of circularity of the toner matrix particles having a core-shell structure reaches the range of average degree of circularity described above.

<<(e) Aging Step>>

Uniformization of the shape of the toner matrix particles in the toner can be promoted to a certain extent through the control of the heating temperature in the aggregation and fusion step described above; however, in order to further promote uniformization of the shape, it is preferable to include an aging step. In this aging step, the surface of the toner matrix particles that have been formed to have a constant particle size and a narrow particle size distribution is controlled to have a smooth and uniform shape by controlling the heating temperature and the heating time. Specifically, the heating temperature used in the aggregation and fusion step is lowered so as to suppress the progress of fusion between resin particles and to promote uniformization, while in this aging step as well, the heating temperature is lowered, and the time is lengthened, to thereby control the toner matrix particles to have a desired average degree of circularity, that is, to have a shape with uniform surface. As described above, the average degree of circularity is preferably 0.920 to 1.000.

<<(f) Cooling Step>>

After the toner matrix particles acquire a desired average degree of circularity, cooling of the dispersion liquid is carried out. At this time, when the cooling conditions are controlled, the state of existence of the respective materials that constitute the toner matrix particles within the toner matrix particles (for example, the domain diameters, shape, and position of existence of the various materials) is changed. When the cooling rate is made slower, for example, aggregation of crystallizing substances is accelerated, and crystal growth may occur. On the other hand, when the cooling rate is made faster, for example, aggregation of crystallizing substances is suppressed, crystallization is not accelerated, and the structure obtained in the aging step tends to be maintained. As described above, regarding a reference for the rate of temperature decrease at which it is easy to bring about a state of co-existence between the structural body and the thread-like structure, which is a feature of the present invention, a rate of temperature decrease of 8° C./min or higher is preferable.

The cooling method is not particularly limited, and examples include a method of cooling the system by introducing a coolant from the outside of the reactor vessel; and a method of cooling the system by directly introducing cool water into the reaction system.

<<(g) Washing and Drying Step>>

The washing and drying step may be carried out by employing various known methods. That is, after the toner matrix particles have been aged to obtain a desired average degree of circularity in the aging step and are cooled, solid-liquid separation is performed using, for example, a known apparatus such as a centrifuge, and washing is carried out. The washing treatment is to perform a water-washing treatment until the electrical conductivity of the filtrate reaches, for example, at a level of 5 μS/cm to 10 μS/cm.

In the drying step, the toner matrix particles that have been washing-treated are subjected to a drying treatment. For the drying, the organic solvent is removed by drying under reduced pressure, if necessary, and then moisture and a trace amount of the organic solvent are removed in a known drying apparatus such as a flash jet dryer and a fluidized bed drying apparatus. The drying temperature is desirably in a temperature range in which the toner matrix particles do not fuse. The amount of moisture contained in the toner matrix particles that have been drying-treated is preferably 5% by mass or less, and more preferably 2% by mass or less.

Furthermore, in a case where the toner matrix particles that have been drying-treated are aggregated by weak interparticle attractive force, a cracking treatment may be carried out.

<<(h) External Additive Treatment Step>>

This external additive treatment step is a step of preparing toner particles by adding external additives as necessary to the drying-treated toner matrix particles, and mixing the toner matrix particles with the external additives. Since the kinds and preferred amounts of addition of the external additives are as described above, further description will not be repeated here. Regarding the method of adding external additives, a dry method of adding the external additives in a powder form to the dried toner matrix particles may be used, and examples of the mixing apparatus include mechanical type mixing apparatuses such as a Henschel mixer and a coffee mill.

[Developer for Electrostatic Latent Image Developing]

The toner of the present invention can be used as a magnetic or non-magnetic one-component developer, but may also be mixed with a carrier and used as a two-component developer. In a case where the toner is used as a two-component developer, regarding the carrier, magnetic particles formed from conventionally known materials, including metals such as iron, ferrite, and magnetite; and alloys of those metals with metals such as aluminum and lead, can be used, and particularly, ferrite particles are preferred. Furthermore, regarding the carrier, a coated carrier having the surface of magnetic particles with a coating agent such as a resin, or a dispersed type carrier obtained by dispersing a fine magnetic powder in a binder resin, may also be used.

The volume-based median diameter of the carrier is preferably 20 μm to 100 μm, and more preferably 25 μm to 80 μm. The volume-based median diameter of the carrier can be measured using, representatively, a laser diffraction type particle size distribution analyzer, "HELOS" (manufactured by Sympatec GmbH.) equipped with a wet type dispersing machine.

[Method for Forming Electrophotographic Image]

The electrostatic latent image developing toner and the developer related to the present invention can be used for various known image forming methods of electrophotographic systems. For example, the electrostatic latent image developing toner and the developer can be used for a black-and-white image forming method or a full-color image forming method. In a full-color image forming method, use can be made of any of image forming methods such as a 4-cycle type image forming method configured to include four kinds of color developing apparatuses related to yellow, magenta, cyan, and black, respectively, and one electrostatic latent image support (also referred to as "electrophotographic photoreceptor" or simply as "photoreceptor"); or a tandem type image forming method in which an image forming unit having a color developing apparatus related to each color and an electrostatic latent image support, is mounted separately for each color.

Regarding the electrophotographic image forming method, specifically, the developer for electrostatic latent image developing related to the present invention is used, and for example, the developer is charged on an electrostatic latent image support using a charging apparatus (charging step) and is exposed imagewise, and thereby an electrostatic latent image is electrostatically formed (exposure step). The electrostatic latent image is developed by charging the toner with the carrier in the developer for electrostatic latent image developing related to the present invention in the developing apparatus, and thereby the electrostatic latent image is visualized to obtain a toner image (developing step). Then, this toner image is transferred onto a recording medium (transfer step), and thereafter, the toner image transferred onto the recording medium is fixed onto the recording medium by a contact heating type fixing treatment (fixing step). Thereby, a visible image is obtained.

The recording medium (also referred to as medium, recording material, recording paper, paper for recording, or the like) may be any recording medium that is generally used, and the recording medium is not particularly limited as long as it is capable of maintaining a toner image. Specific examples thereof include ordinary paper including from thin paper to thick paper, high-quality paper, art paper, rough paper, coated printing paper such as coated paper, commercially available Japanese paper and postcard paper, plastic film for OHP applications, clothes, soft transparent films, and synthetic paper such as YUPO paper. Regarding the toner of the present invention, even if the surface unevenness of the recording medium (medium) is large, low-temperature fixability can be secured, and since bleeding of the mold release agent can be made constant over a wide temperature region, even when the recording medium is changed, variation of gloss in an image (toner image) can be suppressed. That is, a toner having satisfactory low-temperature fixability and excellent shape conformity to the recording medium (medium) is obtained. Furthermore, the toner of the present invention has low environmental dependency of the amount of electric charge.

EXAMPLES

Hereinafter, the effects of the present invention will be described by means of Examples and Comparative Examples, but the technical scope of the present invention is not limited only to the following Examples.

[Production of Crystalline Resin]

<Production of Crystalline Resin (Crystalline Polyester Resin) (c-1)>

45 parts by mass of ethylene glycol, 135 parts by mass of 1,4-butanediol, and 330 parts by mass of adipic acid were introduced into a three-necked flask, and 0.7 parts by mass of dibutyltin oxide as a catalyst and 0.4 parts by mass of hydroquinone were added thereto. The mixture was allowed to react for 5 hours at 160° C. in a nitrogen gas atmosphere. Furthermore, the reaction mixture was further allowed to react at 160° C. at 8.3 kPa until a resin having a desired melting point was obtained, and thus crystalline resin (c-1) was obtained. This crystalline resin (c-1) was analyzed by DSC at a rate of temperature increase of 10° C./min, and it was found that the crystalline resin had a clear peak, while the peak top temperature was 78° C., and the full width at half maximum of the peak was 10° C. Also, the weight average molecular weight of the crystalline resin (c-1) was 24,800.

<Production of Crystalline Resins (Crystalline Polyester Resins) (c-2) to (c-10)>

Crystalline resins (c-2) to (c-10) were produced in the same manner as in the <Production of crystalline resin (c-1)> described above, except that the kinds and amounts of the polyvalent carboxylic acid and the polyhydric alcohol added were changed as indicated in the following Table 1.

TABLE 1

| | Polyvalent carboxylic acid | | Polyhydric alcohol | | | |
|---|---|---|---|---|---|---|
| Crystalline resin | Kind | Number of parts added (parts by mass) | Kind | Number of parts added (parts by mass) | Melting point (° C.) | Mw |
| c-1 | Adipic acid | 330 | Ethylene glycol/ 1,4-butanediol | 45/135 | 78 | 24800 |
| c-2 | Adipic acid | 291 | 1,6-Hexanediol | 219 | 79 | 21600 |
| c-3 | Sebacic acid | 268 | 1,10-Decanediol | 242 | 80 | 22100 |
| c-4 | Adipic acid | 340 | Ethylene glycol/ 1,4-butanediol | 85/85 | 77 | 24000 |
| c-5 | Adipic acid | 306 | Ethylene glycol/ 1,6-hexanediol | 102/102 | 78 | 27300 |
| c-6 | Succinic acid | 452 | Ethylene glycol | 58 | 75 | 23100 |
| c-7 | Adipic acid | 303 | 1,4-Butanediol | 207 | 78 | 25200 |
| c-8 | Fumaric acid | 408 | Ethylene glycol | 102 | 76 | 22800 |
| c-9 | Tetradecanedioic acid | 283 | 1,12-Dodecanediol | 227 | 81 | 26500 |
| c-10 | Adipic acid | 291 | Ethylene glycol | 219 | 75 | 23700 |

<Production of Crystalline Resin (Crystalline Polyester Resin) (c-11)>

167.1 parts by mass of terephthalic acid, 106.2 parts by mass of neopentyl glycol, and 0.4 parts by mass of tetrabutyl titanate were introduced into a reaction apparatus equipped with a stirrer, a thermometer, and a cooler for outflows, and an esterification reaction was carried out for 5 hours at 190° C. Subsequently, the temperature was increased to 220° C., while the pressure inside the system was slowly reduced, and a polycondensation reaction was carried out for 2 hours at 150 Pa. The pressure was first returned to normal pressure, and then 24.4 parts by mass of benzoic acid and 6.3 parts by mass of trimellitic acid were added thereto. The mixture was further allowed to react for 5 hours at 220° C., and thus crystalline resin (c-11) was obtained. The melting point of the crystalline resin (c-11) was 69° C., and the weight average molecular weight (Mw) was 1,800.

[Production of Amorphous Polyester Resin]

<Production of Amorphous Polyester Resin (a-1)>

Into a reactor tank equipped with a cooling tube, a stirrer, and a nitrogen inlet tube, 530 parts by mass of a bisphenol A-2 mol propylene oxide adduct, 145 parts by mass of terephthalic acid, 85 parts by mass of fumaric acid, and 3 parts by mass of titanium tetraisopropoxide as a polycondensation catalyst were introduced in 15 divided portions, and the mixture was allowed to react for 12 hours at 200° C. under a nitrogen gas stream while water produced therein was distilled off. Subsequently, the reaction was carried out under a reduced pressure of 13.3 kPa (100 mmHg), and at the time point at which the softening point became 105° C., the reaction product was taken out. Thus, amorphous polyester resin (a-1) was obtained.

<Production of Amorphous Polyester Resin (a-2)>

An amorphous polyester resin (a-2) was produced in the same manner as in the <Production of amorphous polyester resin (a-1)> described above, except that the kinds and amounts of the polyvalent carboxylic acid and the polyhydric alcohol were changed as follows:

| | |
|---|---|
| Bisphenol A-2 mol propylene oxide adduct | 86 parts by mass |
| Ethylene glycol | 65 parts by mass |
| Terephthalic acid | 141 parts by mass |
| Trimellitic acid | 29 parts by mass |

[Production of Dispersion Liquids of Resin Particles and Colorant Particles]

<Production of Crystalline Resin (Crystalline Polyester Resin) Particle Dispersion Liquid (CD-1)>

300 parts by mass of the crystalline resin (c-1) was melted, and the crystalline resin was transported in a molten state to an emulsifying dispersing machine "CAVITRON CD1010" (manufactured by Eurotec, Ltd.) at a transportation rate of 100 parts by mass per minute. Also, simultaneously with the transportation of this crystalline resin (c-1) in a molten state, dilute aqueous ammonia at a concentration of 0.37% bymass, which was obtained by diluting reagent aqueous ammonia with ion-exchanged water in an aqueous solvent tank, was transported to the relevant emulsifying dispersing machine at a transportation rate of 0.1 liters per minute, while the aqueous ammonia was heated to 100° C. with a heat exchanger. Then, this emulsifying dispersing machine was operated under the conditions of a speed of rotation of a rotor of 60 Hz and a pressure of 5 kg/cm$^2$, and thereby a crystalline resin particle dispersion liquid (CD-1) was prepared. Meanwhile, the dilute aqueous ammonia was added so as to obtain a degree of neutralization of 48%. The dispersion diameter of the crystalline resin particles in the crystalline resin particle dispersion liquid (CD-1) was 180 nm as the volume-based median diameter.

<Production of Crystalline Resin Particle Dispersion Liquids (CD-2) to (CD-15)>

Crystalline resin particle dispersion liquids (C-2) to (C-15) were produced in the same manner as in the <Production of crystalline resin particle dispersion liquid (CD-1)>, except that the kind and the degree of neutralization of the crystalline resin were changed as indicated in the following Table 2.

Meanwhile, for the degree of neutralization, the amount of ammonia used for neutralization was calculated relative to the amount of KOH used for neutralization, and then the value calculated by the following Equation (1) was designated as the degree of neutralization (unit: %).

[Equation 1]

Degree of neutralization (%)=[(Amount of KOH used for neutralization [g])/(Amount of KOH that can neutralize 100% of terminals of crystalline resin(crystalline polyester) [g])]×100 Equation (1)

Degree of neutralization (%)=[(Amount of KOH used for neutralization [g])/(Amount of KOH that can neutralize 100% of terminals of crystalline resin(crystalline polyester)[g])]×100 Equation (1)

TABLE 2

| Crystalline resin dispersion liquid No. | Kind of crystalline resin | Degree of neutralization (%) | Dispersion diameter (nm) |
|---|---|---|---|
| CD-1 | c-1 | 48 | 180 |
| CD-2 | c-2 | 45 | 203 |
| CD-3 | c-1 | 51 | 123 |
| CD-4 | c-2 | 40 | 291 |
| CD-5 | c-3 | 44 | 197 |
| CD-6 | c-4 | 48 | 188 |
| CD-7 | c-5 | 46 | 182 |
| CD-8 | c-6 | 56 | 165 |
| CD-9 | c-7 | 47 | 185 |
| CD-10 | c-2 | 38 | 321 |
| CD-11 | c-8 | 58 | 144 |
| CD-12 | c-9 | 42 | 247 |
| CD-13 | c-9 | 44 | 282 |
| CD-14 | c-5 | 43 | 243 |
| CD-15 | c-10 | 55 | 178 |

<Production of Vinyl Resin Particle Dispersion Liquid (VD-1)>

A solution obtained by dissolving 0.65 parts by mass of sodium dodecyl sulfate in 95 parts by mass of ion-exchanged water was introduced into a reactor vessel equipped with a stirring apparatus, a temperature sensor, a cooling tube, and a nitrogen inlet apparatus, and while the solution was stirred at a stirring rate of 230 rpm under a nitrogen gas stream, the internal temperature was increased to 80° C. After the temperature increase, a solution obtained by dissolving 0.47 parts by mass of potassium persulfate in 18 parts by mass of in-exchanged water was added thereto, and the liquid temperature was adjusted again to 80° C. Monomer mixed liquid 1 as described below was added dropwise thereto for 1 hour, and then the reaction mixture was heated for 2 hours at 80° C. Subsequently, polymerization was performed by stirring the reaction mixture, and thus resin particles [1H] were prepared.

| <Monomer mixed liquid 1> | |
|---|---|
| Styrene | 30 parts by mass |
| n-Butyl acrylate | 7 parts by mass |
| Methacrylic acid | 2 parts by mass |

Monomer mixed liquid 2 as described below was heated to 90° C. while stirred, and in this mixed liquid, 28 parts by mass of hydrocarbon wax W-1 (paraffin wax, n-paraffin ratio: 90%, molecular weight distribution: 26, melting point: 75° C.) and 40 parts by mass of monoester wax W-2 (behenyl behenate, melting point: 73° C.) as mold release agents were dissolved. Thus, monomer mixed liquid 3 containing mold release agents was prepared:

| <Monomer mixed liquid 2> | |
|---|---|
| Styrene | 280 parts by mass |
| n-Butyl acrylate | 78 parts by mass |
| n-Octyl-3-mercaptopropionate | 5.5 parts by mass |

Into a reactor vessel equipped with a stirring apparatus, a temperature sensor, a cooling tube, and a nitrogen inlet apparatus, a solution obtained by dissolving 5 parts by mass of sodium polyoxyethylene(2) dodecyl ether sulfate in 780 parts by mass of ion-exchanged water was introduced, and after the mixture was heated to 98° C., the monomer mixed liquid 3 containing a mold release agent was added thereto. The mixture was mixed and dispersed for 1 hour using a mechanical dispersing machine, "CLEARMIX" (registered trademark) (manufactured by M Technique Co., Ltd.), which had a circulation path, and thus a dispersion liquid including emulsion particles (oil droplets) was prepared. This dispersion liquid was introduced into a reactor vessel equipped with a stirring apparatus, a temperature sensor, a cooling tube, and a nitrogen inlet apparatus, which contained 39 parts by mass (in terms of solid content) of the resin particles [1H] and 1000 parts by mass of ion-exchanged water and was set at a speed of stirring rotation of 90 rpm and an internal temperature of 82° C. Subsequently, an initiator solution obtained by dissolving 4.55 parts by mass of potassium persulfate in 87 parts by mass of ion-exchanged water was added to that dispersion liquid, and this system was subjected to polymerization by heating and stirring the system for 1 hour at 82° C. Thus, resin particles [1HM] were obtained. Furthermore, a solution obtained by dissolving 6.07 parts by mass of potassium persulfate in 120 parts by mass of ion-exchanged water was added to the resin particles, and a monomer mixed liquid composed of the following components was added dropwise thereto for 1 hour under the conditions of a temperature of 82° C.:

| | |
|---|---|
| Styrene | 205 parts by mass |
| n-Butyl acrylate | 100 parts by mass |
| Methacrylic acid | 18 parts by mass |
| n-Octyl-3-mercaptopropionate | 4.4 parts by mass |

After completion of dropwise addition, polymerization was carried out by heating and stirring the mixture for 2 hours, and then the system was cooled to 28° C. Thus, vinyl resin particle dispersion liquid (VD-1) containing a mold release agent and vinyl resin particles, was obtained.

The dispersion diameter of the vinyl resin particles in the vinyl resin particle dispersion liquid (VD-1) thus obtained was 187 nm as the volume-based median diameter, the glass transition point (Tg) was 44° C., and the weight average molecular weight (Mw) was 34,000.

<Production of Vinyl Resin Particle Dispersion Liquids (VD-2) to (VD-27)>

Vinyl resin particle dispersion liquids (VD-2) to (VD-27) were produced in the same manner as in the <Production of vinyl resin particle dispersion liquid (VD-1)>, except that the kind and the amount of the mold release agent added in the method for producing the vinyl resin particle dispersion liquid (VD-1) was changed as indicated in the following Table 3. Meanwhile, W-3 and W-4 are mold release agents as described below.

W-3: Polyvalent ester wax (pentaerythritol tetrabehenic acid ester, melting point: 83° C.)

W-4: Hydrocarbon wax (microcrystalline wax, n-paraffin ratio: 77%, molecular weight distribution: 41, melting point: 83° C.).

TABLE 3

| Vinyl resin dispersion liquid No. | Mold release agent Kind | Number of parts added (parts by mass) | Kind | Number of parts added (parts by mass) |
|---|---|---|---|---|
| VD-1 | W-1 | 28 | W-2 | 40 |
| VD-2 | W-1 | 68 | W-2 | 51 |
| VD-3 | W-1 | 49 | W-2 | 49 |
| VD-4 | W-1 | 57 | W-2 | 49 |
| VD-5 | W-1 | 49 | W-2 | 65 |
| VD-6 | W-1 | 59 | W-2 | 34 |
| VD-7 | W-1 | 24 | W-2 | 40 |
| VD-8 | W-1 | 108 | W-2 | 27 |
| VD-9 | W-1 | 75 | W-2 | 53 |
| VD-10 | W-1 | 75 | W-2 | 50 |
| VD-11 | W-1 | 58 | W-2 | 66 |
| VD-12 | W-1 | 40 | W-2 | 40 |
| VD-13 | W-1 | 49 | W-2 | 74 |
| VD-14 | W-1 | 42 | W-2 | 59 |
| VD-15 | W-1 | 40 | W-2 | 24 |
| VD-16 | W-1 | 56 | W-2 | 56 |
| VD-17 | W-1 | 48 | W-2 | 48 |
| VD-18 | W-1 | 32 | W-2 | 81 |
| VD-19 | W-1 | 64 | W-2 | 24 |
| VD-20 | W-1 | 95 | W-2 | 95 |
| VD-21 | W-1 | 105 | W-2 | 105 |
| VD-22 | W-1 | 74 | W-2 | 74 |
| VD-23 | W-1 | 45 | W-2 | 45 |
| VD-24 | W-3 | 96 | — | — |
| VD-25 | W-4 | 96 | — | — |
| VD-26 | W-1 | 64 | — | — |
| VD-27 | W-2 | 64 | — | — |

W-1: Hydrocarbon wax (paraffin wax, n-paraffin ratio: 90%, molecular weight distribution: 26, melting point: 75° C.)
W-2: Monoester wax (behenyl behenate, melting point: 73° C.)
W-3: Polyvalent ester wax (pentaerythritol tetrabehenic acid ester, melting point: 83° C.)
W-4: Hydrocarbon wax (microcrystalline wax, n-paraffin ratio: 77%, molecular weight distribution: 41, melting point: 83° C.)

<Production of Amorphous Polyester Resin Particle Dispersion Liquid (AD-1)>

600 parts by mass of the amorphous polyester resin (a-1) produced as described above was pulverized using "ROUNDEL MILL Model: RM" (manufactured by Tokuju Corp.). Subsequently, the amorphous polyester resin was mixed with 1,800 parts by mass of a 0.26% by mass solution of sodium lauryl sulfate that had been produced in advance, and the mixture was ultrasonically dispersed for 150 minutes, while stirred, under the conditions of V-level and 300 μA, using an ultrasonic homogenizer, "US-150T" (manufactured by Nissei Corp.). Thus, an amorphous polyester resin particle dispersion liquid (AD-1) having the amorphous polyester resin (a-1) dispersed therein was produced.

<Production of Colorant Particle Dispersion Liquid>

90 parts by mass of sodium dodecyl sulfate was dissolved with stirring in 1,600 parts by mass of ion-exchanged water. While this solution was stirred, 420 parts by mass of carbon black, "REGAL (registered trademark) 330R" (manufactured by Cabot Corp.), was slowly added thereto, and then the mixture was subjected to dispersion treatment using a stirring apparatus, "CLEARMIX (registered trademark)" (manufactured by M Technique Co., Ltd.). Thereby, a colorant particle dispersion liquid having colorant particles dispersed therein was prepared. The dispersion diameter of the colorant particles in this dispersion liquid was measured using MICROTRAC UPA-150 (manufactured by Nikkiso Co., Ltd.), and the dispersion diameter was 117 nm as the volume-based median diameter.

[Production of Toner]

<Production of Toner 1>

(Aggregation and Fusion Step)

Into a 5-liter stainless steel reactor equipped with a stirring apparatus, a cooling tube and a temperature sensor, 46 parts by mass (in terms of solid content) of the "crystalline resin particle dispersion liquid (CD-1)", 454 parts by mass (in terms of solid content) of the "vinyl resin particle dispersion liquid (VD-1)", and 40 parts by mass (in terms of solid content) of the "colorant particle dispersion liquid" were introduced, and 380 parts by mass of ion-exchanged water was further introduced thereinto. While the mixture was stirred, the pH was adjusted to 10 using an aqueous solution of sodium hydroxide at 5 (mol/liter). Subsequently, an aqueous solution of magnesium chloride obtained by dissolving 40 parts by mass of magnesium chloride hexahydrate in 40 parts by mass of ion-exchanged water was added dropwise thereto for 10 minutes. The internal temperature was increased to 75° C., and the particle size was measured using Multisizer 3 (manufactured by Beckman Coulter, Inc., aperture diameter: 50 μm). At the time point at which the particle size reached 6.0 μm as the volume-based median diameter, an aqueous solution of sodium chloride obtained by dissolving 160 parts by mass of sodium chloride in 640 parts by mass of ion-exchanged water was added thereto. Heating and stirring was further continued, and at the time point at which the average degree of circularity reached 0.960 as measured using a flow type particle image analyzer, "FPIA-2100" (manufactured by Sysmex Corp.), the internal temperature was decreased to 25° C. at a cooling rate of 10° C./min. Thus, a dispersion liquid of "toner matrix particles 1" was obtained.

(Washing and Drying)

The dispersion liquid of toner matrix particles 1 produced in the aggregation and fusion step was subjected to solid-liquid separation using a basket type centrifuge, and thus a wet cake of toner matrix particles was formed. This wet cake was washed with ion-exchanged water at 35° C. using the basket type centrifuge, until the electrical conductivity of the filtrate reached 5 μS/cm. Subsequently, the wet cake was transferred to a "FLASH JET DRYER (manufactured by Seishin Enterprise Co., Ltd.), and was dried until the moisture content reached 0.5% by mass. Thus, "toner matrix particles 1" were produced.

(External Additive Treatment Step)

To 100 parts by mass of the "toner matrix particles 1", 1 part by mass of hydrophobic silica (number average primary particle size=12 nm) and 0.3 parts by mass of hydrophobic titania (number average primary particle size=20 nm) were added, and the mixture was mixed using a Henschel mixer. Thus, toner 1 was produced.

<Production of Toner 2 to Toner 30>

Toner 2 to toner 30 were produced in the same manner as in the <Production of toner 1>, except that the kinds and the amounts of the crystalline resin dispersion liquid (CD-1) and the vinyl resin particle dispersion liquid (VD-1) to be added were changed as indicated in the following Table 4. Meanwhile, toner 23 is a toner containing a crystalline resin, a vinyl resin, and an amorphous polyester resin as the resin components. Furthermore, toner 28 is a toner that does not contain a crystalline resin.

<Production of Toner 31>

Toner 31 was produced in the same manner as in the case of toner 1, except that the vinyl resin particle dispersion liquid (VD-3) was replaced with 393 parts by mass of the amorphous polyester resin particle dispersion liquid (AD-1) produced by the method described above, and with 27 parts by mass of mold release agent dispersion liquid (WD-1) and 27 parts by mass of mold release agent dispersion liquid (WD-2) produced by the following method. Toner 31 is a toner that does not contain a vinyl resin.

Production of Mold Release Agent Dispersion Liquid (WD-1)

A solution obtained by mixing 60 parts by mass of the hydrocarbon wax W-1 (n-paraffin ratio: 90%, carbon number distribution: 25) as a mold release agent, 5 parts by mass of an anionic surfactant, "NEOGENRK (registered trademark)" (manufactured by Dai-ichi Kogyo Seiyaku Co., Ltd.), and 240 parts by mass of ion-exchanged water, was heated to 95° C., and the solution was sufficiently dispersed using a homogenizer, "ULTRA-TURRAX (registered trademark) T50" (manufactured by Ika Works, Inc.). Subsequently, the resultant was subjected to dispersion treatment using a pressure ejection type Gaulin homogenizer, and thereby, mold release agent dispersion liquid (WD-1) was produced.

Production of Mold Release Agent Dispersion Liquid (WD-2)

Mold release agent dispersion liquid (WD-2) was produced in the same manner as in the "Production of mold release agent dispersion liquid (WD-1)" described above, except that the mold release agent was changed to the monoester wax W-2 (behenyl behenate).

TABLE 4

| | | Crystalline resin dispersion liquid | | Vinyl resin dispersion liquid/dispersion liquid other than vinyl resin | | Mold release agent dispersion liquid | |
|---|---|---|---|---|---|---|---|
| | | Kind | Number of parts added (in terms of solid content) | Kind | Number of parts added (in terms of solid content) | Kind | Number of parts added (in terms of solid content) |
| Example 1 | Toner 1 | CD-1 | 46 | VD-1 | 454 | — | — |
| Example 2 | Toner 2 | CD-1 | 66 | VD-2 | 434 | — | — |
| Example 3 | Toner 3 | CD-1 | 54 | VD-3 | 446 | — | — |
| Example 4 | Toner 4 | CD-2 | 53 | VD-4 | 447 | — | — |
| Example 5 | Toner 5 | CD-3 | 53 | VD-5 | 447 | — | — |
| Example 6 | Toner 6 | CD-4 | 68 | VD-6 | 432 | — | — |
| Example 7 | Toner 7 | CD-1 | 46 | VD-7 | 454 | — | — |
| Example 8 | Toner 8 | CD-1 | 87 | VD-8 | 413 | — | — |
| Example 9 | Toner 9 | CD-1 | 79 | VD-9 | 421 | — | — |

TABLE 4-continued

| | | Crystalline resin dispersion liquid | | Vinyl resin dispersion liquid/dispersion liquid other than vinyl resin | | Mold release agent dispersion liquid | |
|---|---|---|---|---|---|---|---|
| | | Kind | Number of parts added (in terms of solid content) | Kind | Number of parts added (in terms of solid content) | Kind | Number of parts added (in terms of solid content) |
| Example 10 | Toner 10 | CD-1 | 61 | VD-10 | 439 | — | — |
| Example 11 | Toner 11 | CD-5 | 54 | VD-3 | 446 | — | — |
| Example 12 | Toner 12 | CD-6 | 57 | VD-11 | 443 | — | — |
| Example 13 | Toner 13 | CD-7 | 45 | VD-12 | 455 | — | — |
| Example 14 | Toner 14 | CD-8 | 52 | VD-13 | 448 | — | — |
| Example 15 | Toner 15 | CD-9 | 67 | VD-14 | 433 | — | — |
| Example 16 | Toner 16 | CD-10 | 46 | VD-15 | 454 | — | — |
| Example 17 | Toner 17 | CD-11 | 44 | VD-16 | 456 | — | — |
| Example 18 | Toner 18 | CD-12 | 45 | VD-17 | 455 | — | — |
| Example 19 | Toner 19 | CD-13 | 45 | VD-17 | 455 | — | — |
| Example 20 | Toner 20 | CD-7 | 48 | VD-18 | 452 | — | — |
| Example 21 | Toner 21 | CD-6 | 45 | VD-19 | 455 | — | — |
| Example 22 | Toner 22 | CD-14 | 206 | VD-20 | 295 | — | — |
| Example 23 | Toner 23 | CD-14 | 210 | VD-21/ AD-1 | 289/33 | — | — |
| Example 24 | Toner 24 | CD-14 | 188 | VD-22 | 312 | — | — |
| Example 25 | Toner 25 | CD-1 | 13 | VD-23 | 487 | — | — |
| Example 26 | Toner 26 | CD-1 | 45 | VD-24 | 455 | — | — |
| Example 27 | Toner 27 | CD-1 | 45 | VD-25 | 455 | — | — |
| Comparative Example 1 | Toner 28 | — | — | VD-3 | 500 | — | — |
| Comparative Example 2 | Toner 29 | CD-1 | 46 | VD-26 | 454 | — | — |
| Comparative Example 3 | Toner 30 | CD-15 | 46 | VD-27 | 454 | — | — |
| Comparative Example 4 | Toner 31 | CD-1 | 54 | AD-1 | 393 | WD-1/ WD-2 | 27/27 |

<Production of Toner 32>

A monomer-containing mixture composed of 156 parts by mass of styrene, 44 parts by mass of n-butyl acrylate, 18 parts by mass of carbon black "REGAL 330R" (manufactured by Cabot Corp.), 2 parts by mass of aluminum salicylate compound (BONTRON (registered trademark) E-88; manufactured by Orient Chemical Industries Co., Ltd.), 0.04 parts by mass of divinylbenzene, 6 parts by mass of amorphous polyester resin (a-2), 18 parts by mass of a hydrocarbon wax (paraffin wax, n-paraffin ratio: 98%, molecular weight distribution: 35, melting point: 78° C.) as a mold release agent, and 20 parts by mass of crystalline resin (c-11), was prepared. 15-mm ceramic beads were added to this mixture, and the mixture was dispersed for 3 hours using an attriter (manufactured by Mitsui Miike Machinery Co., Ltd.). Thus, a monomer-containing composition was obtained.

1600 parts by mass of ion-exchanged water and 7 parts by mass of tricalcium phosphate were introduced into a container equipped with a high-speed stirring apparatus, TK-HOMOMIXER (manufactured by Tokushu Kika Kogyo Co., Ltd.), and the mixture was conditioned at a speed of rotation of 12,000 rotations/min and was heated to 70° C. Thus, a dispersing medium system was obtained. To this monomer-containing composition, 35 parts by mass of t-butyl peroxypivalate as a polymerization initiator was added, and this was introduced into the dispersing medium system. A granulation process was carried out for 5 minutes while the speed of rotation was maintained at 12,000 rotations/min in the high-speed stirring apparatus described above. Subsequently, polymerization was performed for 8 hours by maintaining the temperature at 90° C. while the system was stirred at 200 rotations/min by using a propeller stirring blade instead of the stirrer in the high-speed stirring apparatus. After completion of polymerization, the dispersion liquid of the polymer particles thus obtained was cooled, and the polymer particle concentration in the dispersion liquid was adjusted to be 20% by mass by adding ion-exchanged water thereto. This was designated as core particle dispersion liquid (A).

To 200 parts by mass of this core particle dispersion liquid (A), 6 parts by mass of resin microparticle dispersion liquid (PD-1) produced by the production method described below was added at a dropping rate of 0.2 parts by mass/min. Subsequently, the mixture was stirred for 1 hour at 200 rotations/min. Thereby, dispersion liquid (B) was obtained, in which resin microparticles were adhering to the core particle surfaces. Subsequently, this dispersion liquid (B) was heated to 55° C. while being stirred at 200 rotations/min, and then dilute hydrochloric acid at 0.2 mol/liter was added dropwise thereto at a dropping rate of 1 part by mass/min, and dropping of the dilute hydrochloric acid was continued until the pH of the dispersion liquid (B) reached 1.5. Stirring was further continued for 3 hours, and dispersion liquid (C) in which the resin microparticles were fixed was obtained. While this dispersion liquid (C) was stirred at 200 rotations/min, an aqueous solution of sodium hydroxide at 1 mol/liter was added dropwise to the dispersion liquid (C) at a dropping rate of 10 parts by mass/min, and thus the pH of the dispersion liquid (C) was adjusted to 7.2. Subsequently, the dispersion liquid was stirred for 1 hour, and thereby tricalcium phosphate that had been once dissolved was reprecipitated on the core particles having resin microparticles fixed thereon. This dispersion liquid was heated to 70° C., which was a temperature higher than or equal to the Tg of the resin microparticles, and the dispersion liquid was stirred for another 3 hours. Subsequently, the dispersion liquid was cooled to 20° C., and then dilute hydrochloric acid was added thereto until the pH reached 1.5. The dispersion liquid was filtered, washed and dried, and thereby, "toner matrix particles 32" were produced. To 100 parts by mass of these "toner matrix particles 32", 1 part by mass of hydrophobic silica (number average primary particle size=12 nm) and 0.3 parts by mass of hydrophobic titania (number average primary particle size=20 nm) were added, and the mixture was mixed using a Henschel mixer. Thus, toner 32 was produced.

Production of Resin Microparticle Dispersion Liquid (PD-1)

Into a reactor vessel equipped with a stirrer, a condenser, a thermometer and a nitrogen inlet tube, 49.2 parts by mass of a bisphenol A-2 mol propylene oxide adduct, 8.9 parts by mass of ethylene glycol, 21.6 parts by mass of terephthalic acid, 14.3 parts by mass of isophthalic acid, and 5.7 parts by mass of 5-sodium sulfoisophthalate were introduced, and 0.03 parts by as of tetrabutoxytitanate was added thereto as an esterification catalyst. The temperature was increased to 220° C. in a nitrogen atmosphere, and a reaction was performed for 5 hours while the reaction system was stirred. The reaction was further performed for 5 hours under reduced pressure, and thus a polyester resin was obtained. Into a reactor vessel equipped with a stirrer, a condenser, a thermometer and a nitrogen inlet tube, 100 parts by mass of the polyester resin thus obtained, 45 parts by mass of methyl ethyl ketone, and 45 parts by mass of tetrahydrofuran were introduced, and the mixture was heated to dissolve at 80° C. Subsequently, while the system was stirred at 100 rpm, 300 parts by mass of ion-exchanged water at 80° C. was added thereto, and the mixture was dispersed in water. Subsequently, the aqueous dispersion thus obtained was transferred to a distillation apparatus, and distillation was performed until the distilled fraction temperature reached 100° C. After cooling, ion-exchanged water was added to the aqueous dispersion thus obtained, so as to adjust the resin concentration in the dispersion liquid to 20% by mass, and thus resin microparticle dispersion liquid (PD-1) was obtained.

<Production of Developer 100 parts by mass of ferrite cores and 5 parts by mass of copolymer resin particles of cyclohexyl methacrylate/methyl methacrylate (copolymerization ratio: 5/5) were introduced into a stirring blade-attached high-speed mixer, and the mixture was stirred and mixed for 30 minutes at 120° C. Thus, a resin coat layer was formed on the surface of the ferrite cores through a mechanical impact force, and a carrier having a volume-based median diameter of 40 μm was obtained.

The volume-based median diameter of the carrier was measured using a laser diffraction type particle size distribution analyzer, "HELOS" (manufactured by Sympatec GmbH), equipped with a wet type dispersing machine. Toners 1 to 32 were respectively added to the carrier describe above, such that the toner concentration reached 7% by mass. The resultant was introduced into a micro-type V-type mixer (manufactured by Tsutsui Scientific Instruments Co., Ltd.), and the toner and the carrier were mixed for 30 minutes at a speed of rotation of 45 rpm. Thus, developers 1 to 32 were produced.

[Evaluation]

<Observation of Cross-Section of Toner Matrix Particle>

Cross-sections of the toner 1 to toner 32 thus produced were observed according to the observation method described below. In toner 29, which was a Comparative Example, the thread-like structure was not observed, and in toner 30 and toner 32, the structural body was not observed. Furthermore, in toners 1 to 28 and toner 31, both the structural body and the thread-like structure were recognized in the cross-sections in 60% or more of the particles (60 particles) among 100 toner matrix particles. Furthermore, in the cross-sections of toner 1 to toner 32, a crystalline resin having a structure other than the structural body and the thread-like structure was not observed. The measurement results for the domain diameter of the structural body, the average major axis and the average minor axis of the thread-like structure, and the cross-sectional area ratio of the structural body, the thread-like structure and the mold release agent are presented in the following Table 5-1 and Table 5-2.

<<Observation Method for Toner Matrix Particle Cross-Section>>

Observation Conditions

Apparatus: Transmission electron microscope, "JEM-2000FX" (manufactured by JEOL, Ltd.)

Sample: Slice of toner matrix particle dyed with ruthenium tetroxide ($RuO_4$) (thickness of slice: 60 nm to 100 nm)

Accelerating voltage: 80 kV

Magnification ratio: 50,000 times, bright field image

Method for Producing Slice of Toner Matrix Particle 3 parts by mass of the toner 1 thus produced was added to 35 parts by mass of a 0.2% aqueous solution of polyoxyethyl phenyl ether and dispersed therein, and then the dispersion was treated for 5 minutes at 25° C. by ultrasonication (manufactured by Nippon Seiki Co., Ltd., US-1200T). External additives were removed from the toner surface, and thus toner matrix particles for TEM observation were obtained. For the other toners, external additives were removed in the same manner as described above, and toner matrix particles for TEM observation were obtained.

10 mg of the toner matrix particles obtained as described above were dyed once or twice under the conditions of ruthenium tetroxide ($RuO_4$) vapor dyeing as described below, and then the toner matrix particles were dispersed in a photocurable resin, "D-800" (manufactured by JEOL, Ltd.). The resin was cured by UV light, and thus a block was formed. Subsequently, an ultrathin sample having a thickness of 60 nm to 100 nm was cut out from the block using a microtome equipped with diamond saw teeth.

Conditions for Ruthenium Tetroxide Dyeing

Dyeing was performed using a vacuum electron dyeing apparatus, VSC1R1 (manufactured by Filgen, Inc.). According to the apparatus manual, a sublimation chamber containing ruthenium tetroxide was installed in the dyeing apparatus main body, the ultrathin slice thus produced was introduced into the dyeing chamber, and then dyeing was performed under the conditions of room temperature (24° C. to 25° C.), a concentration of 3 (300 Pa), and a time of 10 minutes as the conditions for dyeing with ruthenium tetroxide.

Observation of Crystal Structure

After dyeing, the ultrathin slice was observed within 24 hours in a secondary electron image using a transmission electron microscope, "JEM-2000FX" (manufactured by JEOL, Ltd.).

Method for Measuring Sizes (Domain Diameter, Average Major Axis, and Average Minor Axis) of Structural Body and Thread-Like Structure The size (domain diameter) of the structural body in a cross-section of a toner matrix particle was calculated as a maximum horizontal chord length (CORD H). Specifically, an image of a cross-section of a toner matrix particle produced as described above was captured using a transmission electron microscope, "JEM-2000FX" (manufactured by JEOL, Ltd.), at a magnification ratio of 50,000 times at an accelerating voltage of 80 kV, the photographic image was captured using a scanner, and the maximum horizontal chord length (CORD H) of the structural body was measured using an image processing analyzer, LUZEX AP (manufactured by Nireco Corp.). Also, similarly, for the major axis (long axis) of the thread-like structure, the maximum length (MX LNG) was measured instead of the maximum horizontal chord length (CORD H), and for the minor axis (short axis), the width (BR' DTH) was measured instead of the maximum horizontal chord length (CORD H). The average domain diameter of the structural body, and the average major axis and the average minor axis of the thread-like structure were calculated as arithmetic mean values for one hundred toner matrix particles, in which both the structural body and the thread-like structure were observed.

Cross-Sectional Area Proportions of Structural Body, Thread-Like Structure, and Mold Releasing Agent Measurement was made by a method similar to the method for measuring the sizes of the structural body, the tread-like structure, and the mold release agent as described above. The ratio A of the cross-sectional area of the structural body with respect to the cross-sectional area of the toner matrix particles, the ratio B of the cross-sectional area of the thread-like structure with respect to the cross-sectional area of the toner matrix particles, and the ratio C of the cross-sectional area of the mold release agent that did not form the structural body with respect to the cross-sectional area of the toner matrix particles, were measured using "AREA" of an image processing analyzer, LUZEX AP (manufactured by Nireco Corp.). Meanwhile, regarding the area, a region surrounded by the outer outline (for example, for the structural body, the region surrounded by dotted lines in FIG. 1; and for the thread-like structure, the region surrounded by solid lines in FIG. 1) was measured. These cross-sectional area proportions were also calculated as arithmetic mean values for particles in which both the structural body and the thread-like structure were observed, among 100 toner matrix particles.

Image Forming Method

For image evaluation, modified machine A was produced, which was a product obtained by modifying a commercially available color composite machine, "BIZHUB PRESS (registered trademark) C6000 (manufactured by Konica Minolta, Inc.)" such that the fixing temperature, the amount of toner adhesion, and the system speed could be freely set. The developing apparatus of this modified machine A was charged in sequence with the toners 1 to 32 produced as described above and the developers, and an evaluation was carried out.

Low-Temperature Fixability (Under-Offset)

For the evaluation, a fixing experiment for fixing a solid image at an amount of toner adhesion of 5 g/m$^2$ in an environment of normal temperature and normal humidity (temperature: 20° C., and humidity: 50% RH), was carried out repeatedly by setting the temperature of the lower fixing roller to be lower by 20° C. than that of the upper fixing belt, and changing the temperature of the upper fixing belt to increase from 110° C. to 220° C. at an increment of 5° C. This experiment was carried out at a fixing rate of 280 mm/sec. The evaluation was carried out using A4-sized npi high-quality paper with 64.0 g/m$^2$ (manufactured by Nippon Paper Industries Co., Ltd.).

The term "under-offset" means an image defect in which, when a toner layer passes through a fixing machine, the toner layer is detached from a transfer material such as recording paper because melting of the toner layer caused by the heat applied by the fixing machine is insufficient. The lower limit fixing temperature of the upper fixing belt was evaluated, at which when an image was formed by the method described above, under-offset did not occur. The lower limit fixing temperature was designated as an index for the low-temperature fixability. As this lower limit fixing temperature is lower, superior fixability was obtained, and a lower limit fixing temperature of below 160° C. was considered acceptable.

Shape Conformity to Recording Medium (Medium)

An evaluation was conducted using A4-sized npi high-quality paper with 64.0 g/m$^2$ (manufactured by Nippon Paper Industries Co., Ltd.), A4-sized POD GLOSS COAT paper with 100 g/m$^2$ (manufactured by Oji Holdings Corp.), and HAMMERMILL TIDAL (manufactured by International Paper Company) having a size of 8½ inches×11 inches. When the degree of gloss of each transfer material (blank paper) without any image formed thereon, and the degree of gloss of a solid image were measured, and the differences were designated as Δ(NPI), Δ(POD), and Δ(TIDAL), respectively, a sample for which the maximum values of the absolute value of Δ(NPI)−Δ(POD), the absolute value of Δ(NPI)−Δ(TIDAL), and the absolute value of Δ(POD)−Δ(TIDAL) were 10 or less, was considered to have no problem for practical use.

The degree of gloss was measured using a gloss meter, "MICRO-GLOSS 75°" (manufactured by BYK Additives, Ltd.), at an incident angle of 75° by using an attached standard board as a reference. Meanwhile, the degree of gloss of blank paper was obtained by taking an average value of the degree of gloss measured at 5 points, such as the center and four corners of the transfer material, and the degree of gloss of a solid image was obtained by taking an average value of the degree of gloss measured at 5 points, such as the center and four corners of the image for measurement.

Regarding the image for evaluating the degree of gloss, a fixed solid image that was fixed at a temperature of (lower limit fixing temperature used for the evaluation of under-offset+20° C.) was used.

Chargeability (Environmental Dependency of Amount of Electric Charge)

19 g of a carrier and 1 g of a toner were introduced into a 20-ml glass container, and the mixture was shaken 200 times per minute at a swing angle of 45° and an arm length of 50 cm for 20 minutes, in two environments (low-temperature, low-humidity environment and high-temperature, high-humidity environment) as described below, and the amount of electric charge was measured by a blow-off method:

low-temperature, low-humidity environment: set in an atmosphere of 10° C. and 10% RH High-temperature, high-humidity environment: set in an atmosphere of 30° C. and 85% RH The evaluation was conducted based on the difference between the amount of electric charge in the low-temperature, low-humidity environment and the amount of electric charge in the high-temperature, high-humidity environment. As the difference between the amounts of electric charge in the two environments was smaller, more satisfactory chargeability was obtained, and a sample having a difference of less than 12 μC/g was considered acceptable.

The results of the evaluations described above are presented in the following Table 5-1 and Table 5-2.

TABLE 5-1

| | | Crystalline resin content (relative to resin components) (mass %) | Vinyl resin content (relative to resin components) (mass %) | Evaluation: Average domain diameter of structural body and thread-like structure (nm): Structural body | Average major axis of thread-like structure | Average minor axis of thread-like structure | Cross-sectional area ratio A/(A + B + C) | Low-temperature fixability (under-offset) (° C.) | Shape conformity to recording medium | Charge-ability (μC/g) |
|---|---|---|---|---|---|---|---|---|---|---|
| Example 1 | Toner 1 | 10 | 90 | 205 | 545 | 52 | 0.42 | 120 | 4 | 4.1 |
| Example 2 | Toner 2 | 15 | 85 | 2480 | 502 | 46 | 0.58 | 130 | 7 | 4.6 |
| Example 3 | Toner 3 | 12 | 88 | 1203 | 498 | 50 | 0.5 | 120 | 2 | 4.3 |
| Example 4 | Toner 4 | 12 | 88 | 1598 | 1988 | 63 | 0.53 | 130 | 5 | 4.4 |
| Example 5 | Toner 5 | 12 | 88 | 1004 | 450 | 12 | 0.45 | 120 | 3 | 4.3 |
| Example 6 | Toner 6 | 15 | 85 | 1967 | 1975 | 995 | 0.59 | 130 | 6 | 4.5 |
| Example 7 | Toner 7 | 10 | 90 | 155 | 496 | 49 | 0.39 | 115 | 8 | 3.9 |
| Example 8 | Toner 8 | 20 | 80 | 2710 | 653 | 73 | 0.63 | 135 | 10 | 4.8 |
| Example 9 | Toner 9 | 18 | 82 | 1992 | 554 | 51 | 0.55 | 125 | 3 | 4.6 |
| Example 10 | Toner 10 | 14 | 86 | 2188 | 462 | 43 | 0.61 | 130 | 6 | 4.5 |
| Example 11 | Toner 11 | 12 | 88 | 1805 | 2177 | 154 | 0.51 | 145 | 5 | 4.4 |
| Example 12 | Toner 12 | 13 | 87 | 1102 | 205 | 36 | 0.47 | 120 | 5 | 4.4 |
| Example 13 | Toner 13 | 10 | 90 | 896 | 993 | 60 | 0.5 | 120 | 3 | 4.0 |
| Example 14 | Toner 14 | 12 | 88 | 707 | 110 | 35 | 0.43 | 115 | 6 | 4.3 |
| Example 15 | Toner 15 | 15 | 85 | 1005 | 1102 | 67 | 0.42 | 130 | 5 | 4.4 |
| Example 16 | Toner 16 | 10 | 90 | 1497 | 1998 | 1203 | 0.59 | 150 | 7 | 4.2 |
| Example 17 | Toner 17 | 10 | 90 | 1306 | 305 | 8 | 0.54 | 120 | 6 | 4.1 |
| Example 18 | Toner 18 | 10 | 90 | 1298 | 850 | 497 | 0.49 | 125 | 3 | 4.2 |
| Example 19 | Toner 19 | 10 | 90 | 1301 | 903 | 550 | 0.52 | 130 | 3 | 4.1 |
| Example 20 | Toner 20 | 11 | 89 | 605 | 879 | 51 | 0.3 | 115 | 9 | 4.1 |
| Example 21 | Toner 21 | 10 | 90 | 1760 | 253 | 40 | 0.71 | 135 | 7 | 4.3 |
| Example 22 | Toner 22 | 47 | 53 | 1842 | 995 | 492 | 0.53 | 120 | 5 | 9.3 |
| Example 23 | Toner 23 | 45 | 48 | 1797 | 967 | 456 | 0.52 | 120 | 4 | 10.1 |
| Example 24 | Toner 24 | 42 | 58 | 1607 | 914 | 395 | 0.51 | 115 | 2 | 7.8 |
| Example 25 | Toner 25 | 3 | 97 | 512 | 503 | 48 | 0.5 | 130 | 5 | 3.7 |
| Example 26 | Toner 26 | 10 | 90 | 1100 | 556 | 57 | 0.35 | 115 | 2 | 4.1 |
| Example 27 | Toner 27 | 10 | 90 | 1305 | 404 | 42 | 0.65 | 125 | 2 | 4.2 |

TABLE 5-2

| | | Crystalline resin content (relative to resin components) (mass %) | Vinyl resin content (relative to resin components) (mass %) | Evaluation: Average domain diameter of structural body and thread-like structure (nm): Structural body | Average major axis of thread-like structure | Average minor axis of thread-like structure | Cross-sectional area ratio A/(A + B + C) | Low-temperature fixability (under-offset) (° C.) | Shape conformity to recording medium | Charge-ability (μC/g) |
|---|---|---|---|---|---|---|---|---|---|---|
| Comparative Example 1 | Toner 28 | 0 | 100 | — | — | — | — | 170 | 13 | 3.3 |
| Comparative Example 2 | Toner 29 | 10 | 90 | 1480 | — | — | 1 | 165 | 9 | 4.3 |
| Comparative Example 3 | Toner 30 | 10 | 90 | — | 803 | 42 | 0 | 115 | 15 | 4.2 |
| Comparative Example 4 | Toner 31 | 12 | 0 | 1153 | 187 | 20 | 0.5 | 120 | 7 | 13.2 |
| Comparative Example 5 | Toner 32 | 9 | 85 | — | 748 | 45 | 0 | 115 | 16 | 4.5 |

DISCUSSION

As is obvious from Table 5-1 and Table 5-2 described above, it was found that in toner 1 to toner 27, in which the main component of the resin components included in the toner is a vinyl resin, and when cross-sections of toner matrix particles are observed, a structural body formed by a crystalline resin being in contact with a mold release agent, co-exists with a crystalline resin having a thread-like structure that is not in contact with a mold release agent, all of the characteristics such as low-temperature fixability, shape conformity to the recording medium (medium), and chargeability (environmental dependency of the amount of electric charge) are at a level of being capable of practicalization and are satisfactory. On the other hand, it was found that toner 28 to toner 32, which are Comparative Examples, have a problem in at least one of low-temperature fixability, shape conformity to the recording medium (medium), and chargeability, and these toners are not at a level of being capable of practicalization.

REFERENCE SIGNS LIST

1 crystalline resin
2 mold release agent
3 structural body
4 crystalline resin having a thread-like structure that is not in contact with the mold release agent
5 vinyl resin

What is claimed is:

1. An electrostatic latent image developing toner including toner matrix particles, the toner matrix particles comprising:

resin components comprising a vinyl resin as a main component and a crystalline resin; and a mold release agent, wherein the crystalline resin forms at least two separate structures in the toner matrix particles, each of the toner matrix particles comprises:

a structural body in which one of the structures of the crystalline resin is in contact with the mold release agent; and another of the structures of the crystalline resin being a thread-like structure that is not in contact with the mold release agent, the thread-like structure of the crystalline resin forms domains in the vinyl resin, the average major axis of the domains of the thread-like structure is 200 nm to 2,000 nm, and the average minor axis of the domains of the thread-like structure is 10 nm to 1,000 nm.

2. The electrostatic latent image developing toner according to claim 1, wherein the crystalline resin is a crystalline polyester resin.

3. The electrostatic latent image developing toner according to claim 1, wherein the average domain diameter of the structural body is 200 nm to 2,500 nm.

4. The electrostatic latent image developing toner according to claim 1, wherein, in a cross-section of the toner matrix particles, the ratio of the cross-sectional area of the structural body with respect to the cross-sectional area of the toner matrix particles is designated as A, the ratio of the cross-sectional area of the thread-like structure with respect to the cross-sectional area of the toner matrix particles is designated as B, and the ratio of the cross-sectional area of the mold release agent that does not form the structural body with respect to the cross-sectional area of the toner matrix particles is designated as C, the ratio A/(A+B+C) is 0.35 to 0.65.

5. The electrostatic latent image developing toner according to claim 1, wherein the content of the crystalline resin relative to the total amount of the resin components is 1% to 45% by mass.

6. The electrostatic latent image developing toner according to claim 1, wherein the mold release agent comprises hydrocarbon wax and monoester wax.

* * * * *